US010633127B2

(12) United States Patent
Rearick et al.

(10) Patent No.: US 10,633,127 B2
(45) Date of Patent: Apr. 28, 2020

(54) MODIFIED ATMOSPHERE PACKAGING APPARATUS AND METHOD WITH AUTOMATED BAG PRODUCTION

(71) Applicant: CVP Systems LLC, Elgin, IL (US)

(72) Inventors: Mark Rearick, Glen Ellyn, IL (US); Chris Duszka, Downers Grove, IL (US); Joel Swidergal, Downers Grove, IL (US)

(73) Assignee: CVP SYSTEMS LLC, Elgin, IL (US)

( * ) Notice: Subject to any disclaimer, the term of this patent is extended or adjusted under 35 U.S.C. 154(b) by 193 days.

(21) Appl. No.: 15/814,614

(22) Filed: Nov. 16, 2017

(65) Prior Publication Data

US 2018/0072438 A1 Mar. 15, 2018

Related U.S. Application Data

(63) Continuation of application No. 14/202,952, filed on Mar. 10, 2014, now Pat. No. 9,828,125, which is a (Continued)

(51) Int. Cl.
*B65B 61/12* (2006.01)
*B65B 61/04* (2006.01)
(Continued)

(52) U.S. Cl.
CPC ..... *B65B 9/093* (2013.01); *B65B 25/04* (2013.01); *B65B 25/06* (2013.01); *B65B 31/06* (2013.01);
(Continued)

(58) Field of Classification Search
CPC ..... B65B 41/12; B65B 41/14; B65B 41/16
(Continued)

(56) References Cited

U.S. PATENT DOCUMENTS 3,359,703 A 12/1967 Quaadgras
3,501,085 A 3/1970 Dobmeier
(Continued)

FOREIGN PATENT DOCUMENTS

CA 124496 11/1998
EP 0396838 11/1990
(Continued)

*Primary Examiner* — Gloria R Weeks
(74) *Attorney, Agent, or Firm* — Brinks Gilson & Lione

(57) ABSTRACT

An automatic packaging apparatus is provided, having a conveyor, a continuous longitudinally folded web, cutting and sealing mechanisms for forming flexible pouches from the web. The apparatus also includes processing stations for loading the pouches, transferring fluids (typically gases) into and out of the pouches, and sealing the pouches. Various alternative methods and devices are provided for separating each sealed pouch from the web by either making a continuous cut across a connecting strip of web material downline of the processing stations or pre-perforating the connecting strip upline of the processing stations. When the connecting strip is pre-perforated, a sealed pouch of sufficient weight may be separated from the web passively by a takeaway conveyor, and a lighter sealed pouch may be separated from the web by a tear-off mechanism that grips and pulls the web.

7 Claims, 25 Drawing Sheets

Related U.S. Application Data continuation-in-part of application No. 12/925,288, filed on Oct. 18, 2010, now Pat. No. 8,689,529.

(60) Provisional application No. 61/279,373, filed on Oct. 20, 2009.

(51) Int. Cl.

| | |
|---|---|
| ***B65B 9/093*** | (2012.01) |
| ***B65B 25/04*** | (2006.01) |
| ***B65B 25/06*** | (2006.01) |
| ***B65B 31/06*** | (2006.01) |
| ***B65B 35/24*** | (2006.01) |
| ***B65B 35/44*** | (2006.01) |
| ***B65B 41/16*** | (2006.01) |
| ***B65B 61/02*** | (2006.01) |

(52) U.S. Cl.
CPC ..... *B65B 35/246* (2013.01); *B65B 35/44* (2013.01); *B65B 41/16* (2013.01); *B65B 61/02* (2013.01); *B65B 61/12* (2013.01); *B65B 2220/22* (2013.01)

(58) Field of Classification Search
USPC ..... 493/227, 229, 230, 233, 238
See application file for complete search history.

(56) References Cited

U.S. PATENT DOCUMENTS

| | | | | |
|---|---|---|---|---|
| 3,636,678 | A | 1/1972 | Maros et al. | |
| 3,735,551 | A | 5/1973 | Pratt | |
| 3,817,017 | A | 6/1974 | Titchenal | |
| 3,932,982 | A | 1/1976 | Klapp | |
| 4,285,681 | A | 8/1981 | Walitalo et al. | |
| 4,294,859 | A | 10/1981 | Lundquist et al. | |
| 4,608,808 | A | 9/1986 | Ryan et al. | |
| 4,662,147 | A | 5/1987 | Scheja | |
| 4,759,433 | A | 7/1988 | Kraft | |
| 4,969,310 | A | 11/1990 | Lerner et al. | |
| 5,134,835 | A | 8/1992 | Walkiewicz, Jr. et al. | |
| 5,187,917 | A | 2/1993 | Mykleby | |
| 5,235,794 | A | 8/1993 | Center | |
| 5,284,002 | A | 2/1994 | Fowler et al. | |
| 5,341,625 | A | 8/1994 | Kramer | |
| 5,414,973 | A | 5/1995 | Muller | |
| 5,551,213 | A | 9/1996 | Koelsch et al. | |
| 5,737,906 | A | 4/1998 | Ishimaru | |
| 5,772,565 | A | 6/1998 | Weyandt | |
| 6,006,505 | A | 12/1999 | Natterer | |
| 6,085,490 | A | 7/2000 | Buchko | |
| 6,119,439 | A | 9/2000 | Stevie | |
| 6,182,424 | B1 | 2/2001 | Mahood et al. | |
| 6,395,317 | B1 | 5/2002 | Singh et al. | |
| 6,453,649 | B1 | 9/2002 | Kammler et al. | |
| 6,582,800 | B2 | 6/2003 | Fuss et al. | |
| 6,658,821 | B2 | 12/2003 | Townsend | |
| 6,748,726 | B2 | 6/2004 | Rossi et al. | |
| 6,952,910 | B1 | 10/2005 | Lorsch | |
| 7,037,250 | B2 * | 5/2006 | Albright | B26F 1/18 493/212 |
| 7,076,936 | B2 | 7/2006 | Limousin | |
| 7,448,185 | B2 | 11/2008 | Zeedyk et al. | |
| 7,506,491 | B2 | 3/2009 | Rimondi | |
| 7,571,584 | B2 | 8/2009 | Lerner et al. | |
| 7,694,495 | B2 | 4/2010 | Wehrmann | |
| 7,712,290 | B2 | 5/2010 | Imao | |
| 8,001,749 | B2 | 8/2011 | Negele | |
| 8,276,797 | B2 | 10/2012 | Dwyer et al. | |
| 8,607,537 | B2 * | 12/2013 | Hatsuno | B29C 66/244 53/548 |
| 2001/0011445 | A1 | 8/2001 | Scolaro | |
| 2002/0157353 | A1 | 10/2002 | Smithson et al. | |
| 2003/0037510 | A1 | 2/2003 | McGrane et al. | |
| 2005/0121099 | A1 | 6/2005 | Hansen | |
| 2006/0010835 | A1 | 1/2006 | Shaw et al. | |
| 2006/0086064 | A1 | 4/2006 | Wehmann | |
| 2009/0049803 | A1 | 2/2009 | Limousin | |
| 2010/0025782 | A1 | 10/2010 | Doll et al. | |
| 2011/0036058 | A1 | 2/2011 | Howdeshell et al. | |
| 2012/0090271 | A1 | 4/2012 | Rearick et al. | |
| 2013/0015228 | A1 | 1/2013 | Hada et al. | |
| 2014/0119677 | A1 * | 5/2014 | Lerner | B65D 29/04 383/37 |
| 2014/0190125 | A1 | 7/2014 | Rearick et al. | |
| 2014/0363102 | A1 | 12/2014 | Edwards | |
| 2015/0175288 | A1 | 6/2015 | Alquati | |

FOREIGN PATENT DOCUMENTS

| | | |
|---|---|---|
| EP | 1369826 | 12/2003 |
| EP | 1413703 | 4/2004 |
| GB | 2352006 | 1/2001 |
| WO | 02/26589 | 4/2002 |
| WO | 2008151773 | 12/2008 |

* cited by examiner

MODIFIED ATMOSPHERE PACKAGING APPARATUS AND METHOD WITH AUTOMATED BAG PRODUCTION

CROSS REFERENCE TO RELATED APPLICATIONS

This application is a continuation of U.S. patent application Ser. No. 14/202,952, filed on Mar. 10, 2014, Application Ser. No. 14/202,952 is a continuation-in-part of U.S. patent application Ser. No. 12/925,288, filed on Oct. 18, 2010, granted, now U.S. Pat. No. 8,689,529, which claims priority to U.S. Provisional Patent Application No. 61/279,373, filed on Oct. 20, 2009, the entire disclosures of each of the foregoing applications are hereby expressly incorporated by reference.

FIELD OF THE INVENTION

The present invention relates to an apparatus and method for automatic packaging, particularly for modified atmosphere packaging, in which loads of poultry, beef, ground beef, produce, or any other perishable or non-perishable product requiring a modified atmosphere, are inserted into a plastic bag, air is drawn out of the bag and a gas is injected into the bag, and then the plastic bag is heat sealed to form a gas-tight seal. More particularly, the apparatus also includes means for making a continuous web of interconnected plastic bags from a continuous web of film material, and then feeding the web of bags into product infeed, fluid transfer, and sealing stations to form sealed pouches containing the product loads. This invention also relates to the particular web of plastic bags or flexible pouches made by the apparatus.

BACKGROUND OF THE INVENTION

In the high-volume modified-atmosphere packaging industry, quality and safety concerns demand good and consistent sealing of packages, while profitability concerns demand fast and cost efficient apparatus and packaging methods for products requiring a modified atmosphere. Methods exist which make use of a conveyor apparatus to advance a continuous web of interconnected bags between a pair of opposed belts, insert a product into each bag, draw air out of each bag and inject a gas into the bags, and sever, seal and trim the bags to form product packages containing the product in a sealed, modified atmosphere.

However, existing apparatus and methods have several inefficiencies. For example, known apparatus and methods use an elongate snorkel to draw air out of each bag and inject a relatively inert gas to replace the air. To generally prevent undesired flow of air into a bag or injected gas out of a bag during the air draw-out and gas refill steps, the snorkel has a flattened cross section, enabling it to slide between opposed conveyor belts and into and out of each bag while generally avoiding significant gaps at a mouth of the bag which could allow the undesired gas flow. Consequentially, a design challenge is that the flattened cross-section of the snorkel requires it to have a flat cross-sectional flow area fitting within the circumference, resulting in a slow volumetric draw out and refilling rate for a given flow velocity. On the other hand, increasing the flow velocity risks causing the bag to collapse around the snorkel opening, thus occluding flow.

In addition, providing a web of preformed bags requires using a separate apparatus to form the web of bags, which adds to the total cost of the method, and trimming unsealed edges off of sealed bags requires special trimming equipment and produces waste.

A need therefore exists for faster and more cost-efficient apparatus and methods for modified atmosphere packaging systems.

BRIEF SUMMARY OF THE INVENTION

The present invention provides apparatus and methods for modified atmosphere packaging that is improved in several aspects over existing systems and methods.

In one aspect, a modified atmosphere packaging apparatus includes a section for in-line bag making. In particular, a web of material may be fed into the in-line bag making section, the web of material comprising two layers of film having one longitudinal edge closed by a longitudinal "c-fold" or a seal and one open longitudinal edge. The bag-making section includes means for periodically forming transverse side seals across the web of material to form a chain of bags in which side edges of each bag comprise the side seals, a distal edge of each bag comprises part of the closed longitudinal edge of the web, and an opening of each bag comprises part of the open longitudinal edge of the web. The apparatus also includes means for forming transverse side-seal cuts adjacent the side seals to facilitate separating the bags. Once formed, the bags are advanced along a conveyor to a product infeed section, where a load of product requiring a modified atmosphere, which may for example be a perishable product, is inserted through the opening of each bag. A proximal portion of web material above the side seals is guided between a pair of belts and over a suitable spreader bracket, which may for example be a standard "flex jaw," to facilitate separation of the layers of film to form a mouth for product insertion. The pair of belts may advantageously be timing belts, and are referred to as timing belts in the embodiments illustrated and described herein, although "V-belts" or any other suitable belts may alternatively be used in accordance with the invention.

In another aspect of the invention, wherein the web material is provided in a roll, an unwind mechanism for the roll preferably includes pneumatically operated chucks and a roll drive motor to rotate the roll while the web is fed into the apparatus. These features facilitate mounting and advancing a heavy roll of web material.

In another aspect of the invention, each bag containing a load of product is advanced along the conveyor to a fluid transfer station, where a fluid in the bags, typically air, is removed and replaced with another fluid, typically a preservative in gaseous form. In particular, the opening of each bag is retained between the timing belts, a fluid transfer conduit with a flattened cross section, referred to herein as a "snorkel," is inserted into the opening and between the timing belts, and a fluid is removed from the bag and replaced with another fluid through the snorkel. Preferably, the snorkel includes one or more longitudinal ribs for stiffness, thus permitting the snorkel to be wider without increasing the risk of damage from cyclic stresses. Alternatively, two or more separate narrower snorkels may be used. Providing a wider snorkel or multiple snorkels increases the total cross-sectional area of fluid flow out of and into the bag, thus permitting higher volumetric fluid flow rates out of and into the bag at lower fluid velocities. The present inventors have found that lower fluid velocities reduce the risk of the bag collapsing around the snorkel opening and occluding fluid flow. Due to its flattened cross section, the snorkel may be inserted while the opening remains substantially sealed from the atmosphere outside the bag.

In one embodiment, where the fluid transfer station is adapted to fill the bags with a gas, the apparatus includes a gas accumulation tank in communication with the snorkel to provide a consistent pressure of gas into the bag during gas filling. This promotes consistent volumetric gas flow, thus permitting gas filling to be controlled based on time, resulting in a consistent filled amount of gas. Optionally but preferably, a lifting mechanism is configured to raise the web/bag conveyor at the fluid transfer station so that the snorkel may be inserted into a bag close to the bottom of a tray of product items in the bag, thus taking advantage of air channels created by the typical tapered shape of product trays. Another flexible way to take advantage of various air channels that may be formed in a bag, depending on the product size, shape and orientation within the bag, is to provide a plurality of apertures in the snorkel leading to the snorkel fluid passage so that fluid can flow into and out of the snorkel via a plurality of different flow pathways.

In another embodiment, where the fluid transfer station includes a pump in communication with the snorkel for removing gas from each bag, a vacuum reservoir is disposed between the pump and the snorkel to provide practically instantaneous vacuum pressure to the bag when a valve between the vacuum reservoir and the snorkel is opened.

In still another aspect of the invention, the apparatus includes a pre-perforation knife for forming a perforation intersecting each side-edge cut near the opening of the bags and passing through a proximal web portion located adjacent to the proximal ends of the side seals, to facilitate separation of the filled bags exiting the apparatus. The perforation may follow a diagonal, perpendicularly transverse, or other path from the proximal edge of the web to the proximal end of the side-edge cut. Preferably, the pre-perforation knife has a profile including diagonal tooth segments defining a tooth point at one end and meeting vertical tooth segments at their other end, the vertical tooth segments spaced apart on each tooth to define a perforation cut length, and spaced apart from the vertical tooth segments of neighboring teeth to define a gap spacing between perforation cuts. In this way, a consistent perforation is formed for a range of knife penetration depths corresponding to the vertical extent of the vertical tooth segments.

In yet another aspect of the invention, the apparatus includes a post-cut knife for forming a preferably L-shaped cut intersecting each side-seal cut near the opening of the bags and passing through an upper web portion above the side seals, to completely separate adjacent sealed bags as they exit the apparatus.

In still another aspect of the invention, the apparatus includes a second pair of timing belts that take hold of the web below the proximal ends of the side seals as the web advances past the product infeed station. At least one snorkel is inserted between the second timing belts at a fluid transfer station substantially as described above, and the second timing belts maintain a gas-tight seal in each pouch as the pouch is advanced from the fluid transfer station to a proximal sealing station. The proximal sealing station preferably includes a proximal sealing assembly located outboard of the second timing belts for applying a proximal seal outboard of the second timing belts, the proximal seal meeting the side seals to completely seal the load of product in the pouch.

In yet another aspect of the invention, the apparatus includes a center seal assembly for forming a center seal to divide each pouch into separately sealed compartments. The center seal assembly includes a base and a center-sealing head. The base comprises a resilient sealing foot pad adapted to provide a surface against which the center-sealing head may be pressed onto the pouch to form a generally longitudinal seal connecting the side seals, the generally longitudinal seal located between the folded edge and the proximal ends of the side seals. The base further comprises a longitudinal guide member attached to the foot pad and to a stationary part of the apparatus, thus holding the foot pad in position and serving to guide the web over the foot pad as the web is advanced.

In yet another aspect of the invention, the apparatus includes a control system for inserting product loads into the bags. Preferably, product infeed is controlled by a product infeed boom including a product infeed conveyor belt being inserted a predetermined distance into a bag, and then the product infeed conveyor belt advancing a predetermined distance (relative to the boom) required to discharge the load from a predetermined insertion location on the boom into the bag, as the boom is retracted. As the product infeed conveyor belt discharges a given load, the product infeed conveyor belt may be configured to simultaneously advance a subsequent load from an initial location on the boom to the predetermined insertion location, thus providing a rapid cycle time regardless of the distance that a load must travel on the conveyor belt from its initial placement location to the end of the boom. Alternatively, a photo eye disposed adjacent to a product-infeed pathway detects the interruption of a photo beam when a product being inserted by an insertion mechanism passes in front of the photo eye. Then, when the product has passed beyond the path of the photo beam, the photo eye detects that the photo beam is uninterrupted and signals a timer to begin counting down a predetermined amount of time that it takes for the insertion mechanism to advance the trailing end of the product from the location of the photo beam to a location just inside the bag. After the predetermined amount of time, a signal is sent from the timer to a control system to stop the advance of the insertion mechanism, discharge the product from the insertion mechanism, and return the insertion mechanism to a location for beginning the next insertion.

In still another aspect of the invention, alternative tear-off devices and methods are provided for separating a sealed pouch from a web having a pre-perforated proximal web portion generally as described above. The devices include a pair of opposed gripping members configured to grip and pull a portion of a sealed pouch in a generally downline direction, to tear the upline pre-perforation of the sealed pouch, thereby separating the sealed pouch from the web. The gripping members are preferably rollers, at least one of them driven, and at least one of the rollers, preferably a freewheel roller, is configured to pivot to and from an open and a gripping position, the open position facilitating feeding the web between the rollers.

DETAILED DESCRIPTION OF THE INVENTION

The automatic packaging apparatus of this invention is used to form bags from a two-layer web of flexible material, such as a suitable plastic, and to package meats, poultry, produce, other perishable goods, or any other product requiring a modified atmosphere, in the bags. The bags preferably have a modified atmosphere that is achieved by extracting the air from the bag and injecting a gas, preferably containing preservatives, into the bag.

Figure 1:
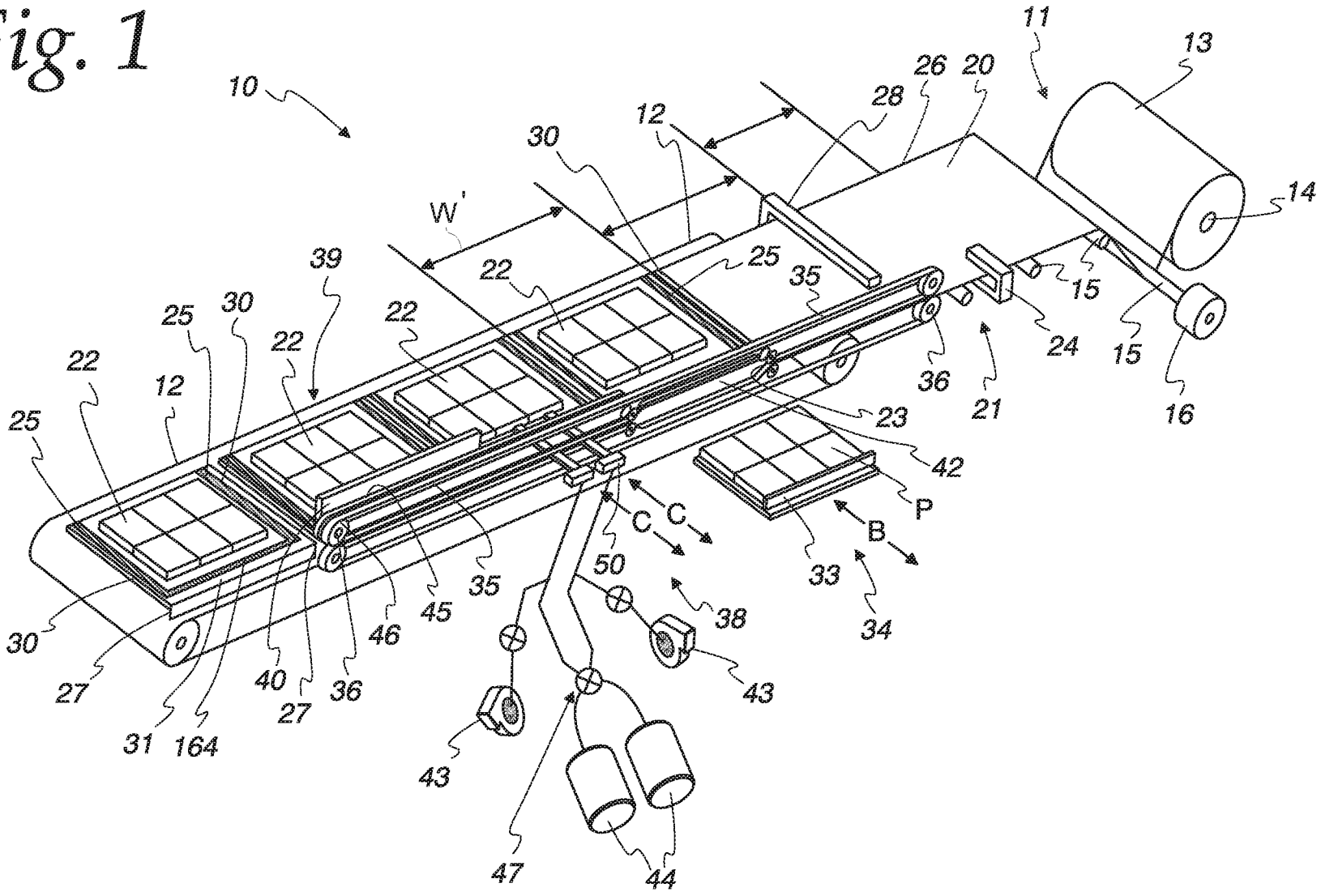
FIG. 1 is a schematic illustration of a modified atmosphere packaging apparatus according to one embodiment of the present invention.
Figure 2A:
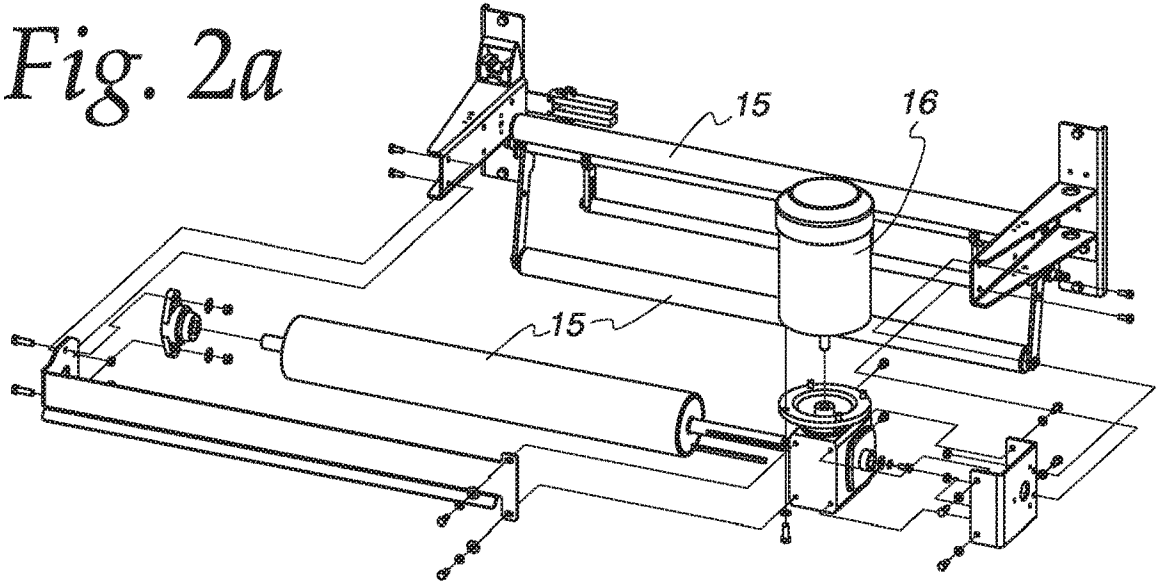
FIG. 2*a* is a detailed exploded view of one embodiment of a film unwind assembly of the packaging apparatus.
Figure 2B:
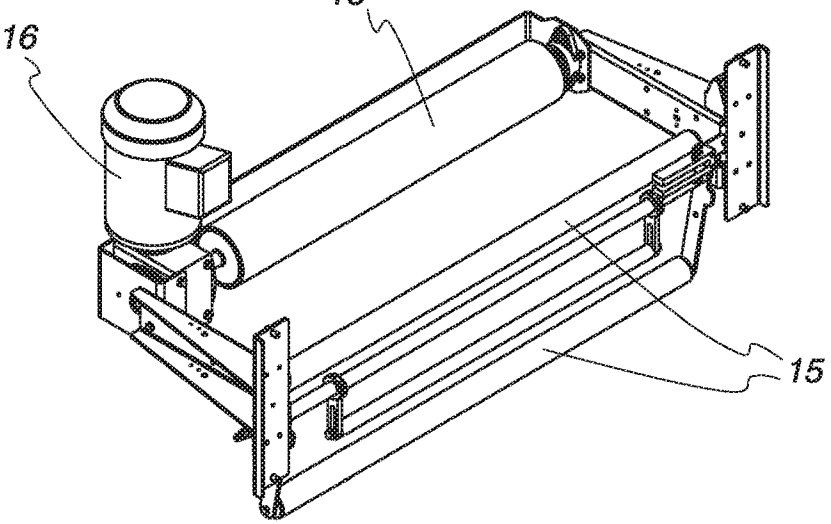
FIG. 2*b* is a detailed assembled perspective view of the film unwind assembly depicted in FIG. 2*a*.

With reference to FIG. 1 for a complete schematic, the structure and function of an automatic packaging apparatus 10 according to the present invention will now be described. A web unwind assembly 11 and a web conveyor belt 12 cooperate to advance web material 20 through apparatus 10, as shown in FIG. 1. Conveyor belt 12 is driven and operated by any conventional means known within the art. In web unwind assembly 11, web material 20 is shown in a roll 13 being fed from a web spool 14. Web material 20 is preferably routed over web guide rollers 15, one of which may be powered by an unwind motor 16 as depicted in FIG. 1. Advantageously, an unwind motor 16 is positioned between web roll 13 and the rest of apparatus 10, thus separating unwind motor 16 from friction or other resistance associated with the other components, and enabling unwind motor 16 to efficiently power the rotation of web roll 13 to advance web material 20 with relatively lower tension on web material 20 than would be required further downline. This is an especially significant benefit when roll 13 has a substantial mass and thus requires substantial torque to rotate intermittently. In a still more preferred embodiment shown in FIG. 10, the rotation of web spool 14 may be powered directly by an unwind motor 16', thus eliminating the need for the rotation of roll 13 to be powered by tension on web 20, which beneficially avoids the risk of damage to web 20 caused by that tension. A more detailed depiction of web unwind assembly 11 is presented in FIGS. 2*a*, 2*b*, and 3*a*-3*c*.

Web material 20 preferably comprises a continuous, longitudinally folded ("c-folded") sheet of flexible material having a distal folded edge 26, from which flexible bags, referred to herein as "pouches" 22, are formed in a bag-making station 21 of apparatus 10, which includes a pre-perforation assembly 24 for forming a diagonal pre-perforation 27 (shown in FIGS. 1 and 4*a*), and an edge perforator-sealer 28 for forming side seals 25 and side edge cuts 30 of pouches 22 and permitting pouches 22 to be separated from one another. It should be noted that the term "pouch" is used to refer to pouches 22 in the present description not to draw any distinction between a "pouch with an open end" and a "bag," which should be considered interchangeable terms for purposes of understanding the present invention. Rather, the term "pouch" is used for reference to the embodiments illustrated in the Figures merely because it is aptly applied to pouches 22 both before and after they are sealed, thus avoiding the need to apply two different terms. The term "bag," on the other hand, if applied to pouches 22 after they are completely sealed, could misleadingly suggest an open end. Thus, notwithstanding exceptional common usages such as "bean bag" which may refer to fully closed forms, the term "bag" as used herein means a flexible enclosure with a single open end, of which each pouch 22 is an example before it is completely sealed.

The aforementioned components are shown in the context of an overall schematic in FIG. 1 and in more detail in FIGS. 3*a*-3*c* and FIG. 3*d*, where bag-making station 21 and pre-perforation assembly 24 thereof are shown, respectively. In the illustrated embodiment, each interconnected flexible pouch 22 formed in web 20 has a folded edge 26 and side seals 25, as shown in FIG. 1 and in an enlarged view for clarity in FIG. 4*a*. Side seals 25 are preferably heat sealed since flexible pouch 22 is preferably constructed of plastic material. It is apparent that folded edge 26 is inherently sealed from the atmosphere and thus need not be heat sealed, although the distal edge of web 20 could alternatively comprise any suitable seal formed between two initially separate layers of material, which may for example be a heat seal or a cold adhesive seal, within the scope of the invention.

Figure 4A:
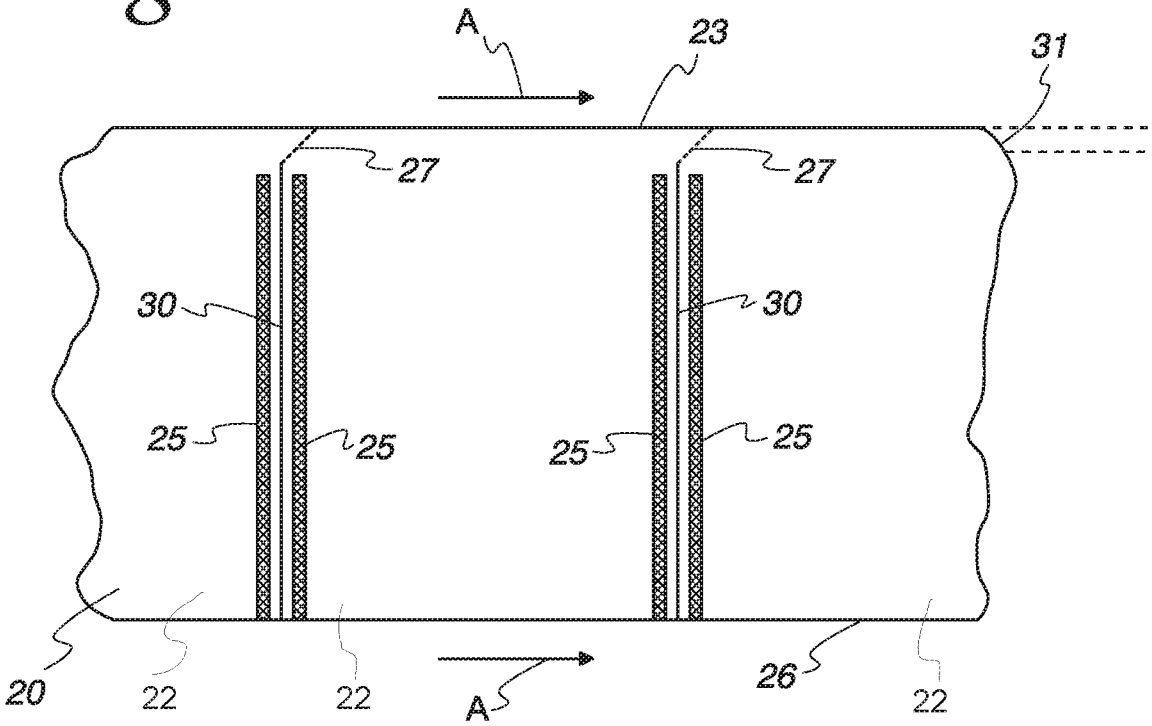
FIG. 4*a* is a fragmentary view of a portion of a web of interconnected bags formed by the bag making section.

To permit separation of adjacent flexible pouches 22, the side edges of flexible pouches 22 are preferably cut along the lines depicting side edge cut 30 and may be perforated along the dashed lines depicting diagonal pre-perforation 27, as best seen in FIG. 4*a*. Side edge cut 30 is preferably a complete cut rather than a perforation, thus eliminating the need for subsequent tearing along cut 30 to separate pouches 22. Pre-perforation 27, on the other hand, must be a perforation rather than a complete cut, as a proximal portion 31 of web 20 must remain intact as it passes through apparatus 10, as will be explained in further detail below.

Figure 4B:
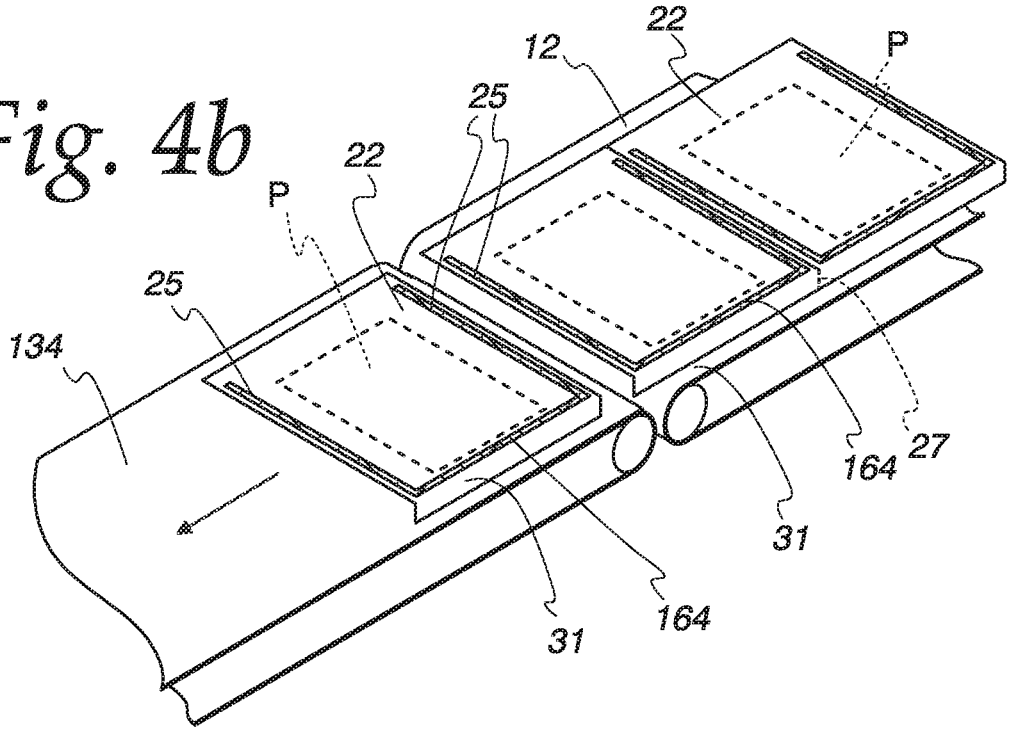
FIG. 4*b* is a schematic illustration of a pouch being separated from an adjacent pouch as it is carried downline by a takeaway conveyor in accordance with a method of the present invention.

The present inventors have found that a diagonal pre-perforation 27 has multiple advantages. For example, because the diagonal line of pre-perforation 27 is oblique to the vertical line of side edge cut 30, some leeway in either longitudinal direction is permitted in the positioning of pre-perforation 27, so that pre-perforation 27 will still meet side edge cut 30 in the event of slight misalignment. Also, a perforation having given cut lengths and spacing between cuts is easier to tear by a longitudinal force when the perforation is oriented diagonally than when the perforation is oriented perpendicularly transversely, because the longitudinal force produces sheer stress components aligned with the diagonal cuts. Thus, the diagonal orientation of pre-perforation 27 helps to facilitate tearing along pre-perforation 27 when a pouch 22 is pulled away from its upline neighbor by a longitudinal takeaway conveyor 134, as illustrated schematically in FIG. 4*b*. On the other hand, due to the greater complexity of forces applied to proximal portion 31 of web 20 as it is conveyed through a packaging apparatus according to the invention, for example those associated with the opening of a spreader bracket (described below), the present inventors believe that cutting through as little material as feasible when forming pre-perforation 27 is a more reliable way of preventing premature tearing along pre-perforation 27 than orienting pre-perforation 27 in a particular direction. Therefore, a diagonal direction of pre-perforation 27 is advantageous in that it allows for easy separation of pouches 22 after sealing despite a relatively short cut length and/or a relatively large spacing between cuts of pre-perforation 27. Resistance to premature tearing in particular is a significant benefit, as some previous attempts to operate a similar apparatus on a web of interconnected bags with perpendicularly transverse perforations across the entire web had failed due to premature tearing of the proximal portion of web that was guided between timing belts. Thus, previous designs had resorted to omitting a perforation through the proximal portion of web altogether, and then longitudinally trimming this portion after sealing of the bags to permit separation of adjacent sealed pouches, which led to undesired waste and complexity of design.

Nonetheless, although a diagonal pre-perforation 27 has the aforementioned benefits, a perpendicularly transverse pre-perforation may be more desirable for other reasons and is also possible according to the present invention, notwithstanding the greater challenges of properly aligning a perpendicularly transverse pre-perforation with a side-edge cut 30 and of properly selecting the cut length and gap size of the pre-perforation to balance the goals of resistance to premature tearing and ease of separation of pouches. Above all, pre-perforating proximal web portion 31 transversely according to the present invention, whether diagonally or perpendicularly, advantageously eliminates the need for trimming proximal web portion 31 longitudinally, thus greatly reducing waste and simplifying apparatus 10.

Figure 3A:
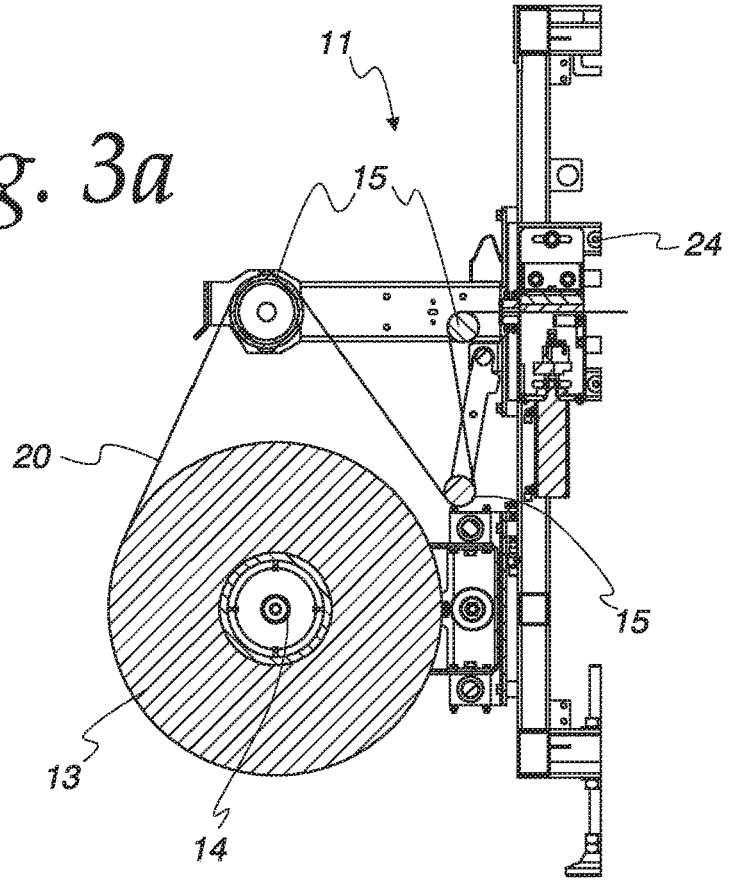
FIG. 3*a* is a detailed side view of one embodiment of a film unwind assembly and a pre-perforation assembly of the packaging apparatus.
Figure 3B:
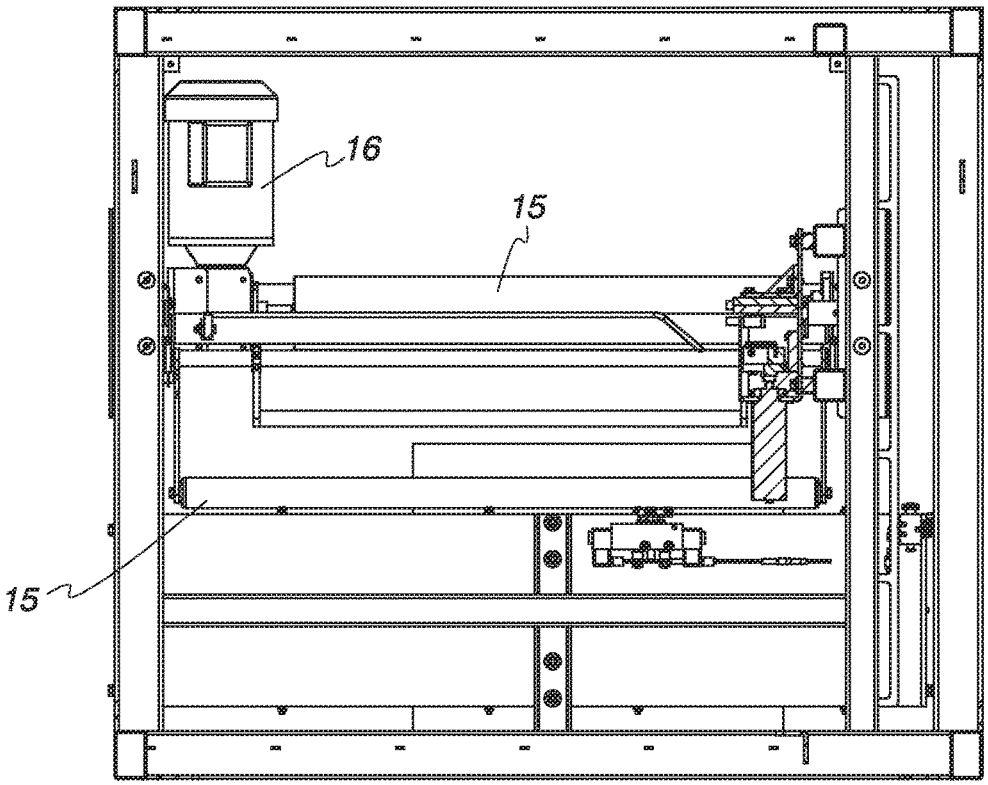
FIG. 3*b* is a detailed rear elevation view of the pre-perforation assembly and film unwind assembly shown in FIG. 3*a*.
Figure 3C:
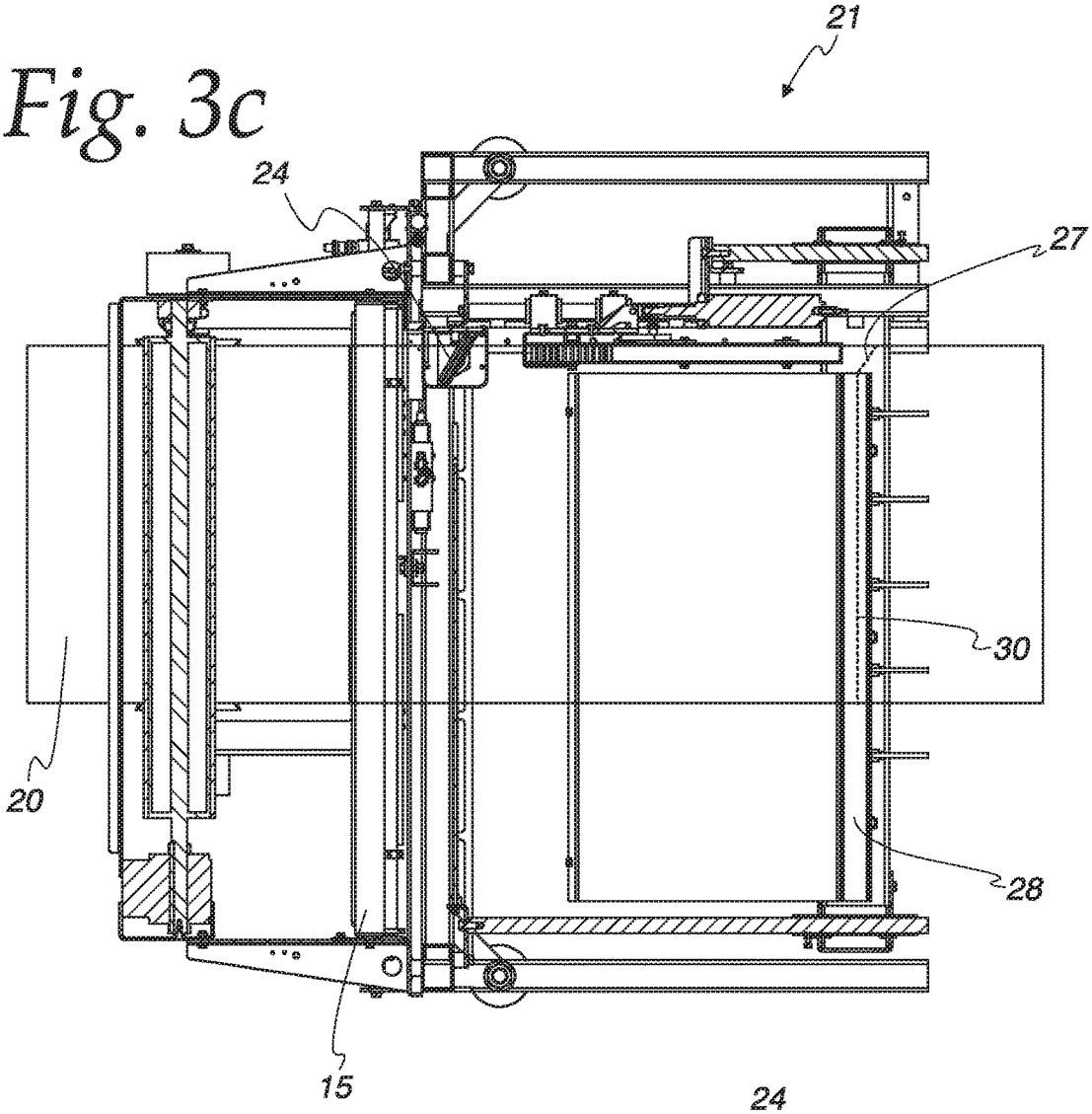
FIG. 3*c* is a detailed plan view of a film unwind assembly, pre-perforation assembly, and sealing station of the packaging apparatus.
Figure 3D:
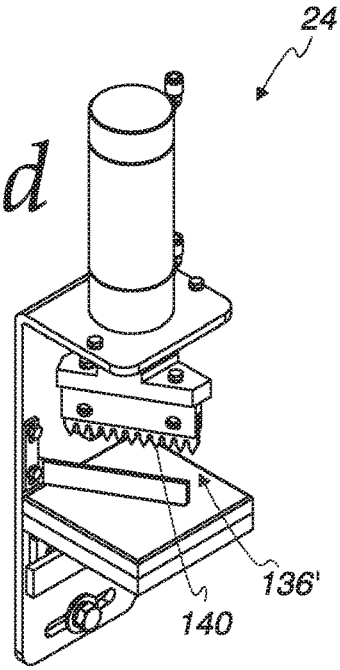
FIG. 3*d* is an enlarged perspective view of the pre-perforation assembly shown in FIGS. 3*a*-3*c*, separated from the packaging apparatus.
Figure 3E:
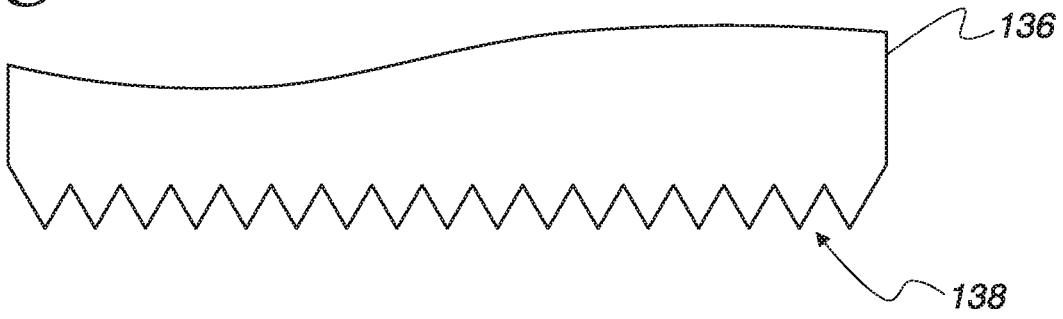
FIG. 3*e* is a fragmentary detail view of one embodiment of a pre-perforation knife.
Figure 3F:
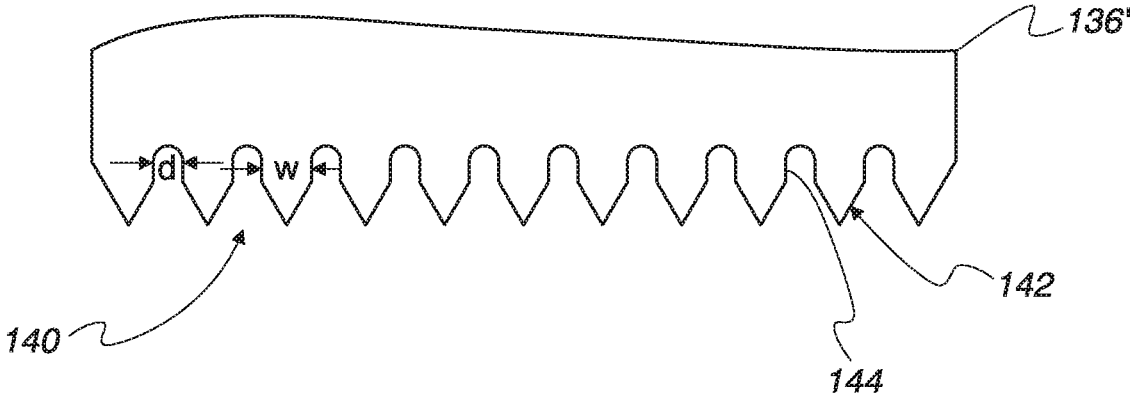
FIG. 3*f* is a fragmentary detail view of a preferred embodiment of a pre-perforation knife.

Turning to FIGS. 3*e* and 3*f*, one embodiment of a pre-perforation knife 136 and a more preferred embodiment of a pre-perforation knife 136' are illustrated in fragmentary detail, respectively. Pre-perforation knife 136 includes a simple zigzag saw-tooth cutting profile 138 shown in FIG. 3*e*, while pre-perforation knife 136' includes a preferred cutting profile 140 with angled tooth edge segments 142 and vertical parallel tooth edge segments 144. In this manner, pre-perforation knife 136' is adapted to provide pre-perforation 27 with individual cuts consistently having a cut length w corresponding to a tooth width w and being spaced apart by a predetermined distance d corresponding to a tooth gap distance d, by penetrating web 20 to a depth within a range corresponding to the vertical extent of parallel tooth edge segments 144. This is a significant improvement over the simple zigzag saw-tooth cutting profile 138 of pre-perforation knife 136, for which both the width of individual cuts and the distance between individual cuts vary over the entire range of depths to which pre-perforation knife 136 penetrates web 20. Consequently, although simple zigzag pre-perforation knife 136 is within the scope of the present invention, its design requires precise calibration of penetration depth to achieve a desired spacing between cuts in a perforation, whereas preferred pre-perforation knife 136' permits some room for error in penetration depth while still achieving a desired cut length w and cut spacing distance d. Precise control of perforation cut length and spacing is important, as too small a spacing and/or too large a cut width could result in the premature pre-perforation tearing mentioned above, while too large a spacing and/or too small a cut width could make separation of pouches 22 too difficult. This benefit of preferred pre-perforation knife 136' is particularly advantageous when a perpendicularly transverse pre-perforation is desired, as a perpendicular pre-perforation requires greater material removal for the same ease of pouch separation in the manner described above, while it is critical to avoid removing too much material to prevent premature tearing.

According to the embodiment shown in FIG. 1, film take-up timing belts 35 and timing belt pulleys 36 are used to direct proximal portion 31 of web material 20 in downline advancing web direction A, as indicated in FIG. 4*a*, through automatic packaging apparatus 10. Timing belts 35 are preferably used to maintain a gas-tight seal with respect to each pouch 22 that conveyor belt 12 moves in a downline direction from a fluid transfer station 38 to a proximal sealing station 39. Thus, side heat seal 25 preferably extends as close to timing belts 35 as feasible. Depending on the particular arrangement, additional seal timing belts 45, disposed parallel to and slightly to the distal side of transfer timing belts 35, may be desirable, so that the proximal ends of side heat seals 25 are covered by seal timing belts 45, providing a complete seal as pouch 22 is advanced from fluid transfer station 38 to proximal sealing station 39.

A product infeed station 34 is configured to separate an open proximal end 23 of pouch 22 and insert a load of product into pouch 22. As depicted in simple schematic sketches in FIGS. 1 and 5, and in more detailed schematic sketches in FIGS. 6*a*-6*d*, product infeed station 34 comprises a product infeed conveyor 33 for inserting product P into flexible pouch 22. Product infeed conveyor 33 moves into and out of pouch 22, in directions indicated by arrow B in FIGS. 1 and 5.

In one embodiment, a product infeed conveyor 33' includes a product infeed boom 51 that is configured to advance and retract transversely with respect to pouch 22 and an endless product infeed conveyor belt 53 that is mounted to boom 51 and configured to advance in a looped pathway around boom 51. In this manner, once boom 51 has advanced product P to a position above a desired location inside pouch 22, product infeed conveyor belt 53 may be configured to advance, and boom 51 to retract simultaneously at the same rate, so that product P is discharged from the end of boom 51 and placed at the desired location inside pouch 22, as illustrated in FIGS. 6*a*-6*d*.

Figure 5:
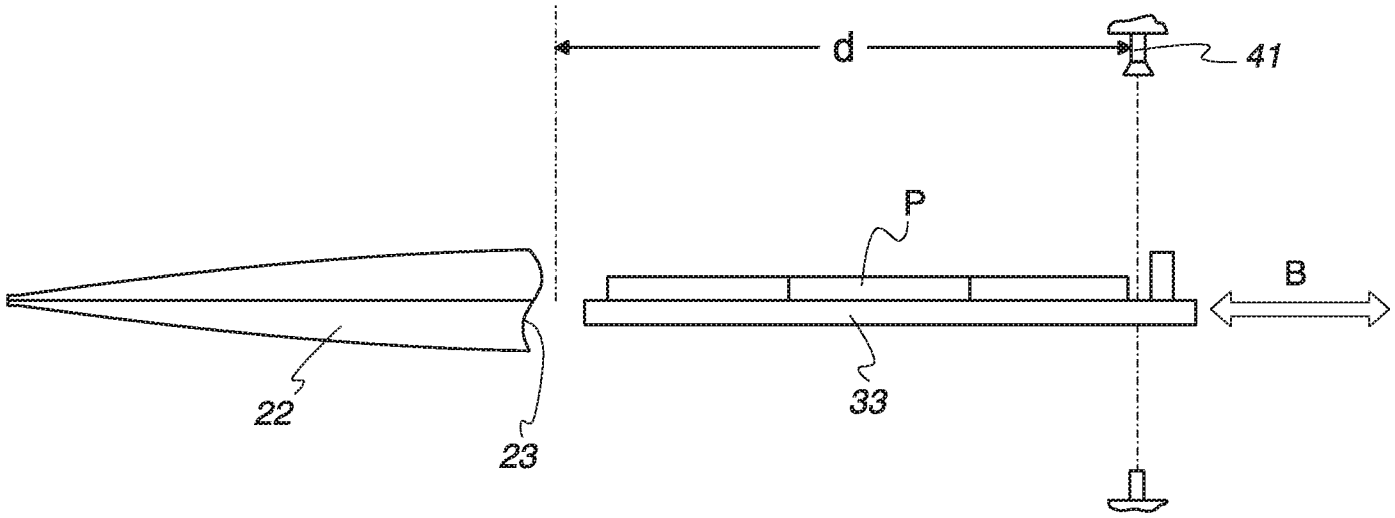
FIG. 5 is a schematic illustration of a photo-eye control sensor arrangement for load insertion according to one aspect of the present invention.

In another embodiment depicted in FIG. 5, the inward movement of product infeed conveyor 33 is controlled based on input from a photo eye 41 configured to detect when the trailing edge of product P passes photo eye 41, at which moment a control system directs product infeed conveyor 33 to move a predetermined distance into pouch 22 corresponding to a distance d between a point below photo eye 41 and a point just inside pouch 22, so that the trailing edge of product P is fully inside pouch 22. In this manner, product infeed conveyor 33 will advance approximately the minimum distance required to fully insert product P, regardless of the length of product P. Then product infeed conveyor 33 is directed to discharge product P in any suitable manner, such as that described and illustrated with reference to FIGS. 6*b* and 6*c*, and to return to a retracted position ready for the next insertion.

Figure 6A:
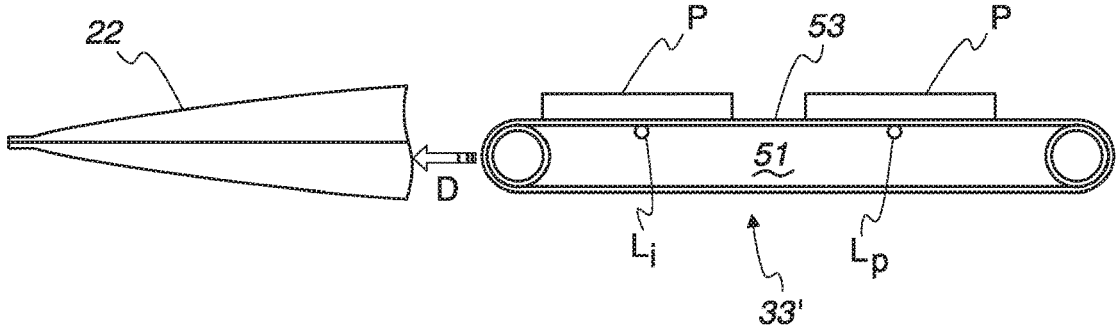
FIG. 6*a* is a schematic illustration of an infeed conveyor according to another aspect of the present invention, just prior to insertion of a load into a pouch.
Figure 6B:
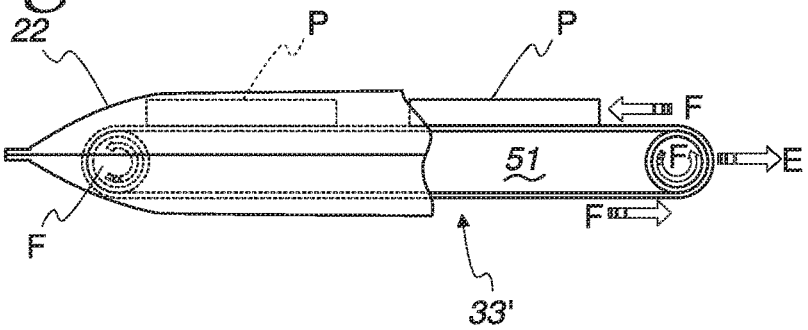
FIG. 6*b* is a schematic illustration of the infeed conveyor just after insertion of a load into a pouch.
Figure 6C:
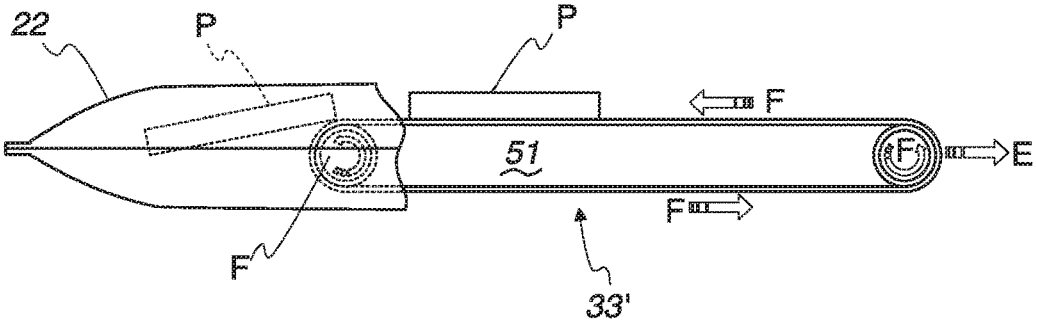
FIG. 6*c* is a schematic illustration of the infeed conveyor beginning to retract and discharge a load.
Figure 6D:
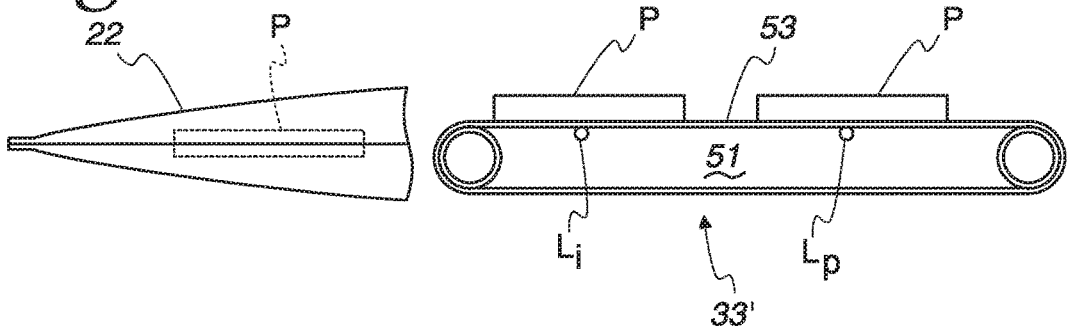
FIG. 6*d* is a schematic illustration of the infeed conveyor after a load has been discharged, the infeed conveyor retracted, and another load placed on the infeed conveyor.

More preferably, product P may be positioned at a predetermined insertion location $L_i$ on product infeed conveyor 33', and product infeed conveyor 33' may be controlled by a simple timer to advance boom 51 in the direction indicated by arrow D in FIG. 6*a* the distance required move product P at predetermined insertion location $L_i$ on boom 51 to a location inside pouch 22, and then to retract boom 51 in the direction indicated by arrow E in FIGS. 6*b* and 6*c* while product infeed conveyor belt 53 advances in the direction indicated by arrows F in FIGS. 6*b* and 6*c* to discharge product P into pouch 22 as described above. If product infeed conveyor 33' is significantly longer than product P, product infeed conveyor 33' is advantageously configured so that product infeed conveyor belt 53 advances product P in one or more discrete steps from a predetermined placement location $L_p$ proximate to the rear of boom 51 to the predetermined insertion location $L_i$. The length of each discrete step advantageously corresponds to the distance by which product infeed conveyor belt 53 advances to discharge each successive load of product P, so that as boom 51 retracts, product infeed conveyor belt 53 simultaneously discharges one load of product P and advances the next load of product P to predetermined insertion location $L_i$, thus providing a rapid cycle time.

Figure 7A:
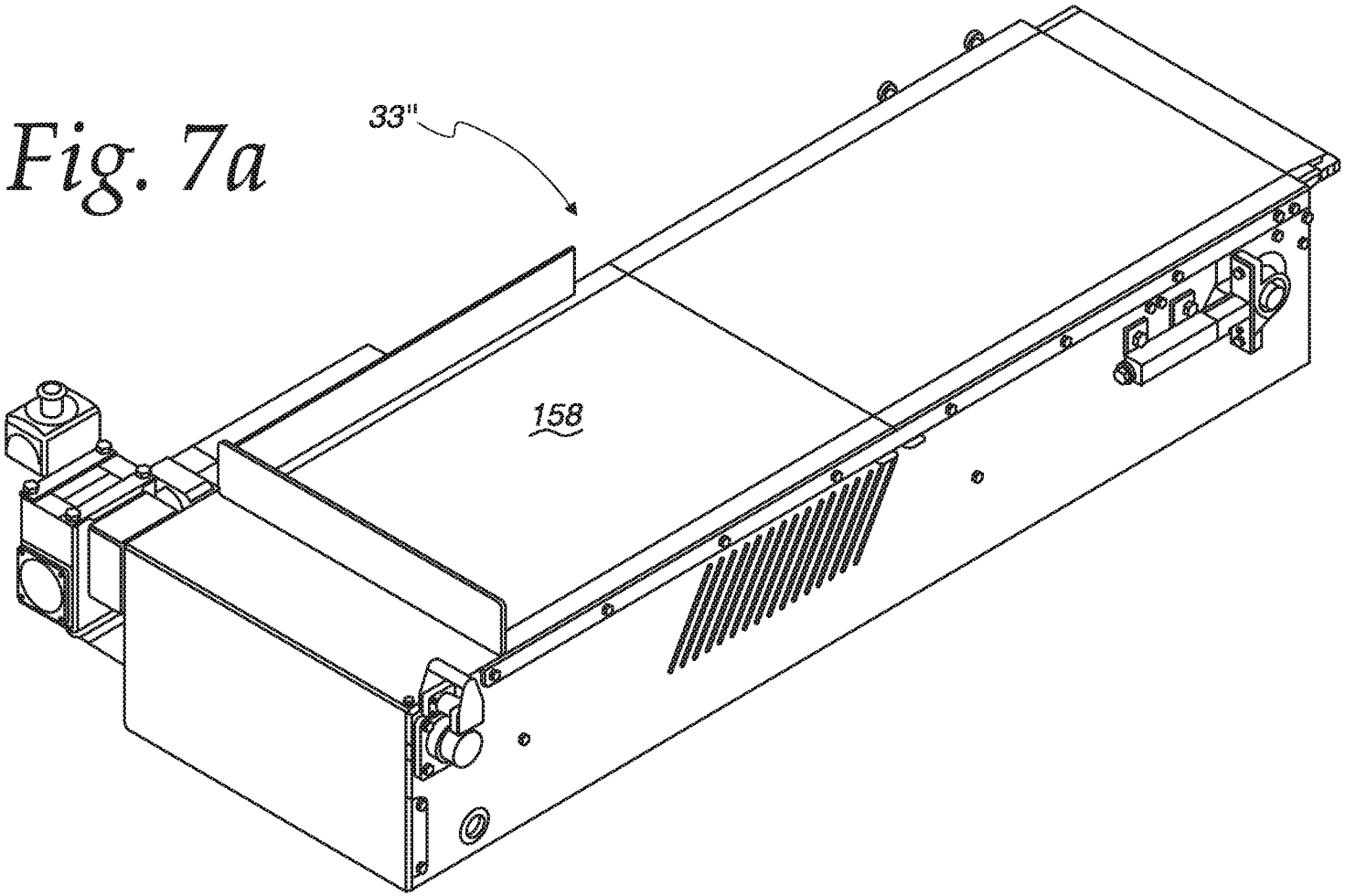
FIG. 7*a* is a perspective view of a preferred infeed conveyor according to the invention.
Figure 7B:
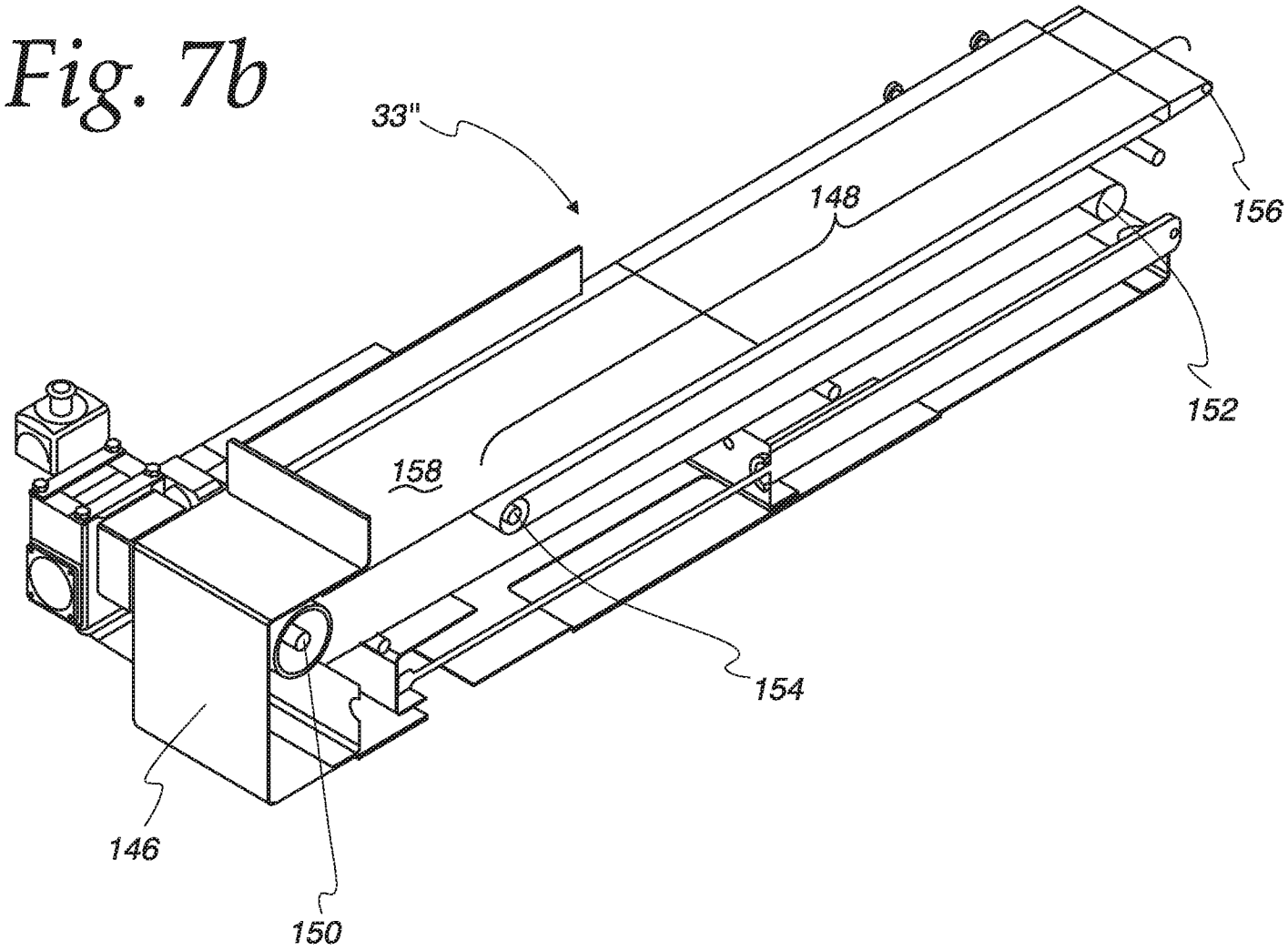
FIG. 7*b* is a perspective sectional view of the infeed conveyor shown in FIG. 7*a*.
Figure 7C:
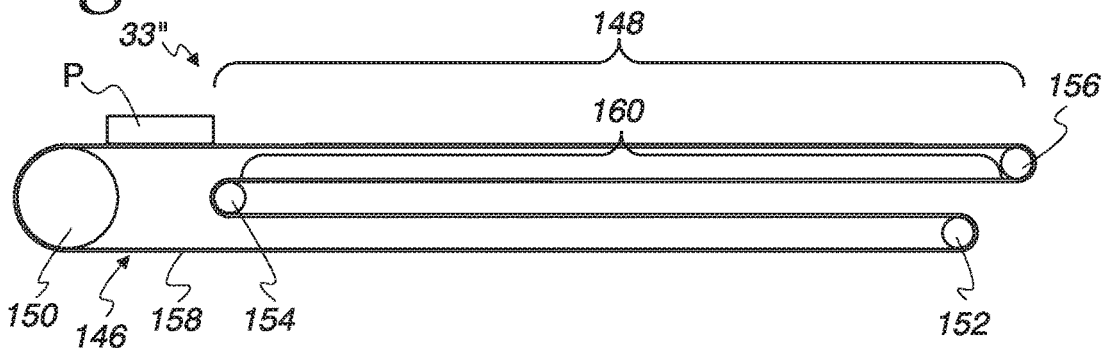
FIG. 7*c* is a side schematic illustration of the preferred infeed conveyor after product placement and prior to boom insertion.
Figure 7D:
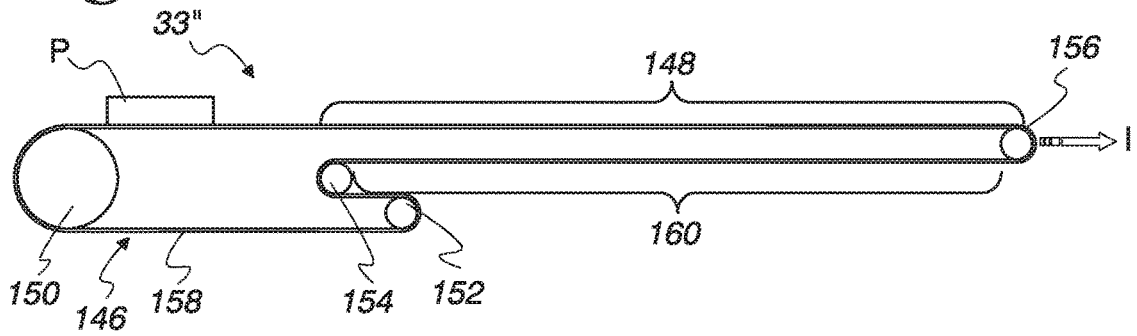
FIG. 7*d* is a side schematic illustration of the preferred infeed conveyor after boom insertion and prior to advancing a belt to advance the product.
Figure 7E:
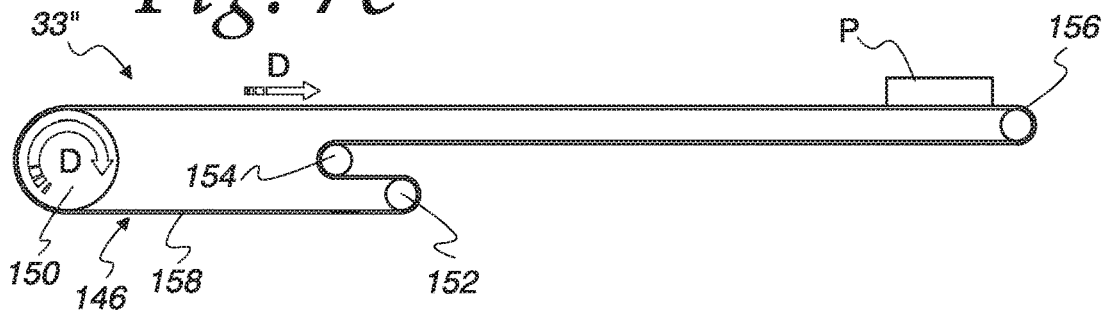
FIG. 7*e* is a side schematic illustration of the preferred infeed conveyor after advancing a belt to advance the product and prior to boom retraction to discharge the product.
Figure 7F:
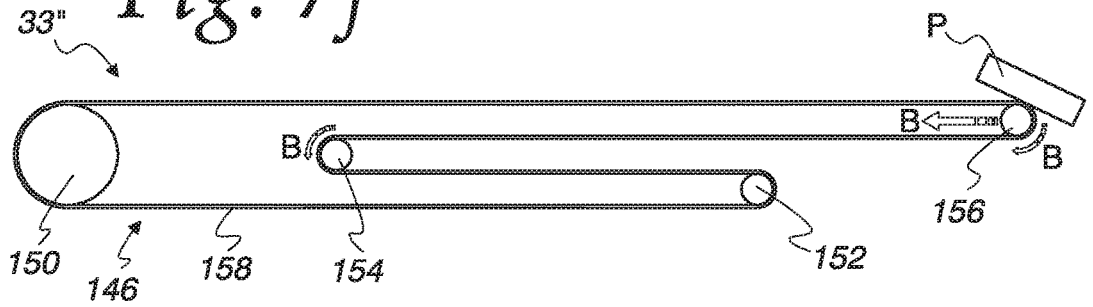
FIG. 7*f* is a side schematic illustration of the preferred infeed conveyor during boom retraction to discharge the product.

In another still more preferred embodiment illustrated in perspective view in FIG. 7*a*, sectional perspective view in FIG. 7*b*, and schematically in FIGS. 7*c*-7*e*, a product infeed conveyor 33" includes a stationary frame portion 146 and a boom portion 148. Stationary rollers 150 and 152 mounted to stationary frame portion 146 are configured to rotate in fixed positions, while boom rollers 154 and 156 mounted to boom portion 148 are configured to move together with boom portion 148 in an insertion direction and a retraction direction and to rotate relative to boom portion 148. An infeed belt 158 is mounted to rollers 150, 152, 154, and 156 as shown. At least one of stationary rollers 150 and 152 is a drive roller (shown as roller 150, with reference to FIG. 7*e*), while boom rollers 154 and 156 are idler rollers. Infeed belt 158 is configured not to slip relative to the drive roller, so that when the drive roller is not driving infeed belt 158, only a boom length 160 of infeed belt 158 that is supported between boom rollers 154 and 156 is permitted to move during insertion and retraction of boom portion 148, while the remaining length of infeed belt 158 remains stationary. As a result, when boom portion 148 is retracted, infeed belt 158 is "pulled out from under" a stationary product load P supported on infeed belt 158 above the distal end of boom portion 148, to discharge product load P in place, as illustrated in FIG. 7*e*, while only boom length 160 of infeed belt 158 moves relative to boom portion 148 in the direction indicated in FIG. 7*f* by arrows B. Thus, a kinematic advantage of the four-roller design of infeed conveyor 33" is that simply retracting boom portion 148 is all that is required to discharge a product load in place. Conversely, a kinematic advantage of the two-roller design of infeed conveyor 33' is that the step of inserting a product load P can be performed by the single action of advancing infeed boom 51 in the direction indicated by arrow D in FIG. 6*a*, whereas the four-roller design of infeed conveyor 33" requires insertion in two steps, by advancing boom portion 148 forward in insertion direction I, as indicated in FIG. 7*d*, and driving belt 158 forward, as indicated in FIG. 7*e* by arrows D showing the rotation of drive roller 150 and the resulting advancing movement of belt 158. Of course, it will be understood that it is within the scope of the invention to perform the boom insertion and belt driving steps simultaneously if desired, to speed up cycle time. The four-roller design of infeed conveyor 33" also provides an energy-saving advantage. In particular, because belt 158 is inherently held in place relative to stationary frame portion 146, and thus belt 158, by remaining still, passively "moves forward" relative to the backward motion of boom portion 148, boom portion 148 need not include a roller drive motor to drive belt 158 forward when boom portion 148 retracts. Thus, the weight requirements of boom portion 148 are reduced, so that advancing and retracting boom portion 148 consumes relatively little power. In contrast, the two-roller design of infeed conveyor 33' requires either a motor to drive infeed belt 53 or some additional extrinsic adaptation, which might for example be a rack and pinion system or equivalent (not shown) that would automatically engage the rollers to drive belt 53 forward as boom 51 is retracted, perhaps including a ratchet mechanism so that belt 53 would not be conversely driven backward, but rather would remain stationary relative to boom 51, as boom 51 is inserted. Overall, it should be understood that any suitable conveyor mechanism adapted for inserting a product load into a pouch, and then discharging the product load from the conveyor mechanism in place within the pouch, is within the scope of the invention.

Product infeed station 34 preferably comprises a conventional spreader bracket such as a "flex jaw" for separating flexible pouch 22 to form a mouth 42 for receiving product P, as shown in FIG. 1. In particular, transfer timing belts 35 and proximal web portion 31 are routed around the spreader bracket, and when a pouch 22 is aligned with product infeed station 34, the spreader bracket opens to an expanded configuration shown in FIG. 1 to form mouth 42.

According to the embodiment shown in FIG. 1, once flexible pouch 22 is supplied with a load, control means are used to move conveyor belt 12 in a downline direction. Flexible pouch 22 is thus moved downline to a fluid transfer station where fluid transfer means are used to draw a fluid, preferably air, from flexible pouch 22. Preferably, the fluid transfer means are adapted to draw out substantially all of the air from pouch 22 to help create a modified atmosphere for product P. For example, in one embodiment, the fluid transfer means may be configured to draw out air for a predetermined amount of time required to draw out substantially all of the air contained in pouch 22 when it reaches fluid transfer station 38. Alternatively, the fluid transfer means may be directed by a control system to draw out air until a pressure gauge (not shown) senses a desired vacuum pressure in pouch 22. The fluid transfer means are then used to inject a fluid, preferably a gas, into flexible pouch 22.

As shown in FIG. 1, the fluid transfer means include a first and a second snorkel 50, each in communication with a vacuum pump 43 and dual gas accumulation tanks 44. Preferably, both snorkels 50 are in communication with both gas accumulation tanks 44 via a plumbing assembly 47, as illustrated schematically in FIG. 1. In this manner, if each tank 44 is filled with a different gas composition, pouch 22 may be filled with a selected gas composition by directing gas from a selected tank 44 through both snorkels 50 and into pouch 22. For example, one tank 44 may be filled with a mixture of about 0.4% carbon monoxide, about 30% carbon dioxide, about 69.6% nitrogen to provide a low- to no-oxygen modified environment in pouch 22, while the other tank 44 may be filled with a mixture of about 80% oxygen and 20% carbon dioxide to provide a high-oxygen modified environment in pouch 22. Alternatively, if each tank 44 is filled with the same desired gas composition, gas from both tanks may be simultaneously directed through both snorkels 50 to provide greater pressure and thus a higher flow rate when desired, to speed up the filling process.

Gas filling following vacuum purging of each pouch 22 has several potential benefits. For example, a small amount of carbon monoxide promotes color stability and inhibits growth of anaerobic organisms. Carbon dioxide, on the other hand, inhibits bacterial growth and mold. Nitrogen is beneficially included as a filler gas for meat packaging, as it is not absorbed into meat, and therefore preserves headspace and prevents pouch collapse due to carbon dioxide absorption, for example. Gas filling to provide high oxygen levels may be useful, for example, in packaging red meat, where preservation of the "meat bloom" for a perfect red color is desired. On the other hand, where oxygen is not desired, the gas filling composition may include $O_2$ scavengers or absorbers to reduce residual amounts of oxygen trapped in a tray or in meat, for example.

Figure 8A:
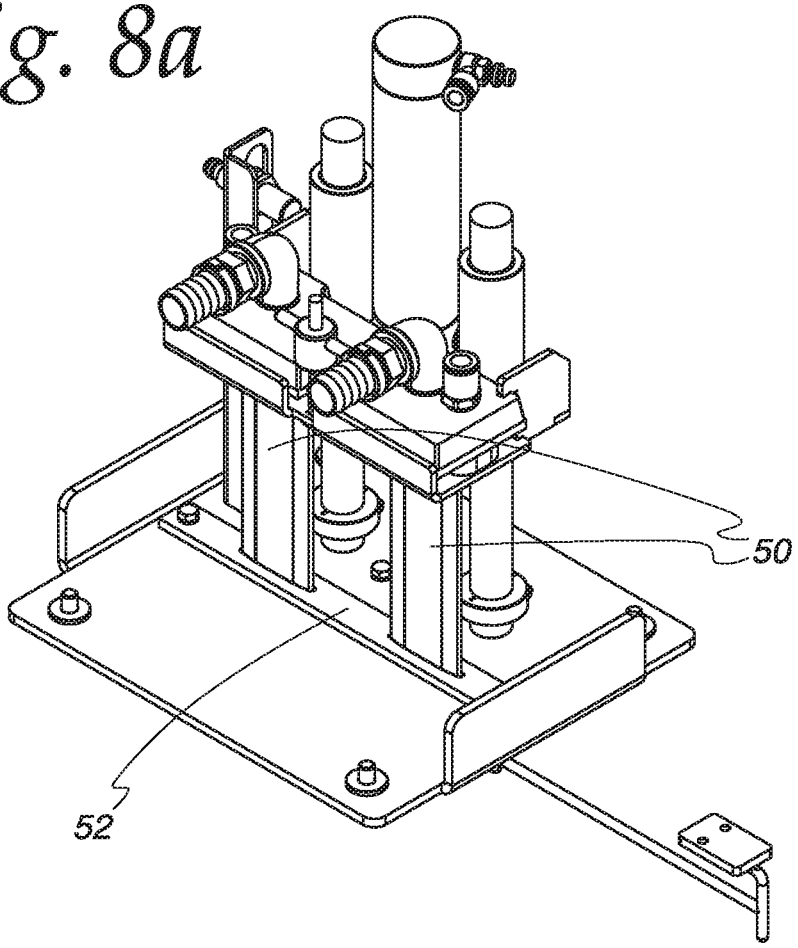
FIG. 8*a* is a detailed perspective view of one embodiment of a dual-snorkel assembly according to the present invention.
Figure 8B:
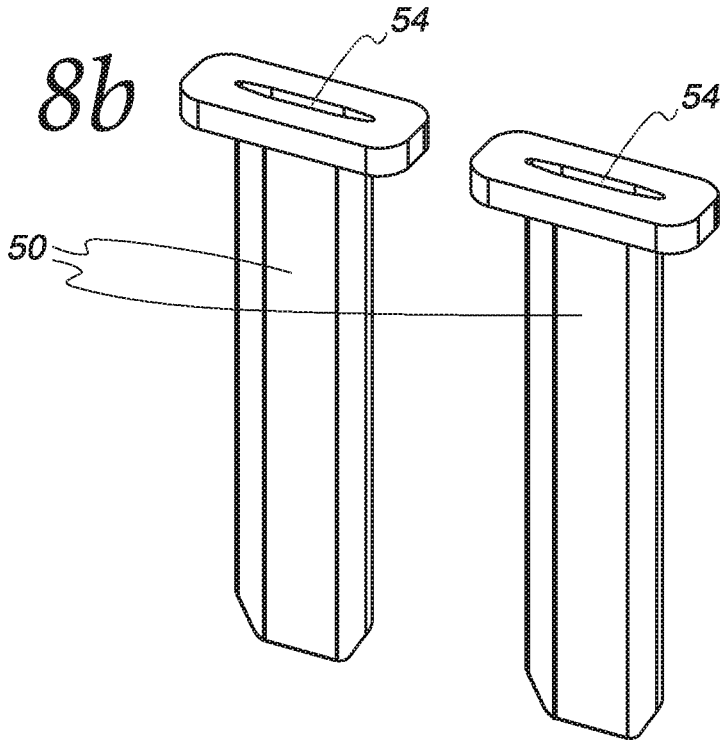
FIG. 8*b* is a detailed perspective view of dual snorkels separated from the dual-snorkel assembly.
Figure 8C:
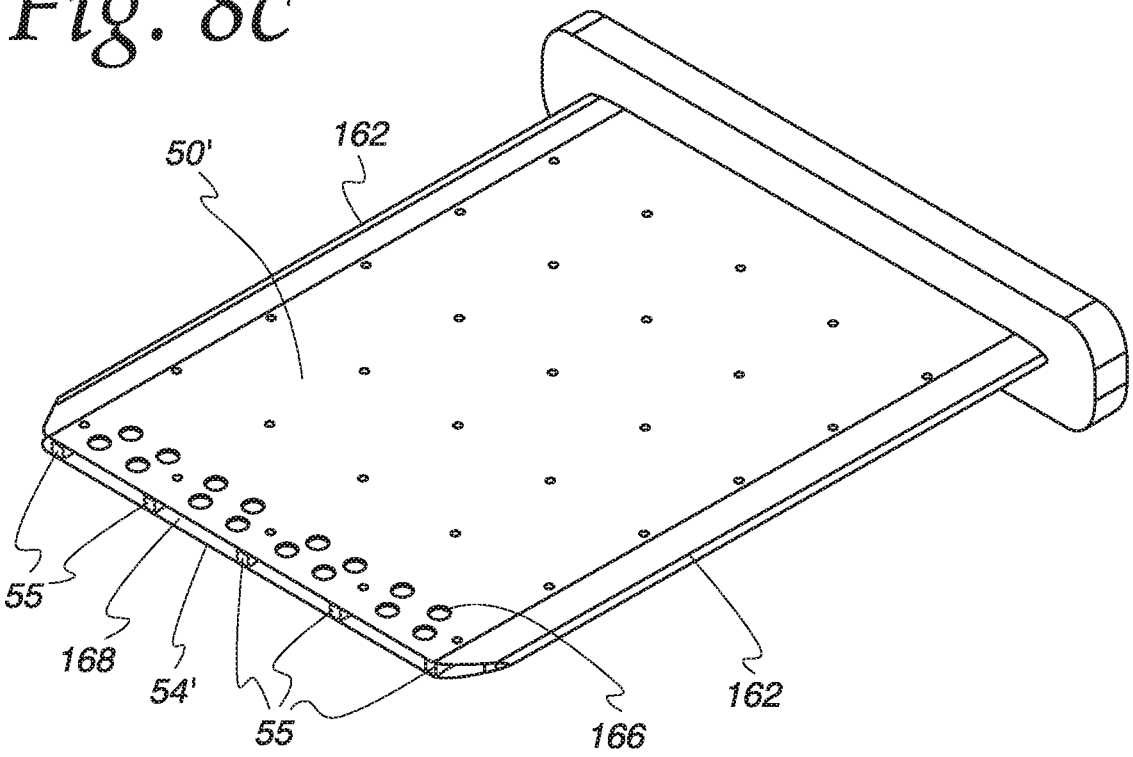
FIG. 8*c* is a detailed perspective view of a preferred single, wider snorkel according to another aspect of the present invention.

Snorkels 50 preferably move into and out of flexible pouch 22 in a direction along the corresponding arrows C, as shown in FIG. 1. The present inventors have discovered increasing the cross-sectional flow area of a snorkel used in fluid transfer station 38 provides significant benefits. For example, multiple snorkels 50 as depicted in FIGS. 8*a* and 8*b* provide a greater total cross-sectional flow area than a single snorkel 50 of the same size, thus permitting greater volumetric vacuum flow rate of gas, and thus an increase in process speed, without increasing air velocity. The present inventors have found that lower air velocity decreases the risk of pouch 22 collapsing around or over the intake opening of snorkels 50, potentially occluding the opening and blocking or restraining vacuum flow. Still more preferably, for simplicity and compactness of design, a single, wider snorkel 50' having a wider fluid passage 54' may be used to achieve the increased cross-sectional flow area, as seen in FIG. 8*c*. However, it should be noted that the wider snorkel 50' may require accommodations for increased stiffness which may for example include thicker walls (not shown), stiffer material, and/or one or more longitudinal ribs 55 as shown in FIG. 8*c*, because the walls of a snorkel with a wider cross-sectional flow area tend to be prone to greater transverse bending stresses. Thus, without accommodations for increased stiffness, the side edge welds 162 of wider snorkel 50' would be more likely than those of narrower snorkels 50 to be damaged by cyclical fluid pressures associated with purging and refilling pouches 22.

After the completion of fluid transfer, flexible pouch 22 is then moved downline by conveyor belt 12 to proximal sealing station 39 where open end 23 is sealed to form a proximal seal 164 (see FIG. 4*b*), preferably by heat sealing with a heat seal bar 40, to form a gas-tight seal within flexible pouch 22. Transfer and/or seal timing belts 35, 45, or other suitable web transfer means, are used to maintain a gas-tight seal with respect to each flexible pouch 22 that conveyor belt 12 transports from fluid transfer station 38 to proximal sealing station 39.

Some components of the fluid transfer means according to two embodiments of the invention are depicted in more detail in FIGS. 8*a*-8*c*, and 9*a*-9*c*. Referring to FIG. 8*a*, a dual-snorkel unit assembly is shown in a detailed perspective view. Snorkels 50 are slidably mounted with respect to a guide 52. Each snorkel 50 preferably has a flat, elongate shape, as seen in FIG. 8*b*. This shape permits snorkel 50 to sealably extend between transfer timing belts 35 and into a pouch 22. In addition, the outer surfaces of snorkel 50 should be smooth, i.e., free of any burs or snags that could catch on and potentially tear web 20. Each snorkel 50 has at least one fluid passage 54. Each passage 54 is in communication with a positive pressure supply and a vacuum pressure supply.

Figure 9A:
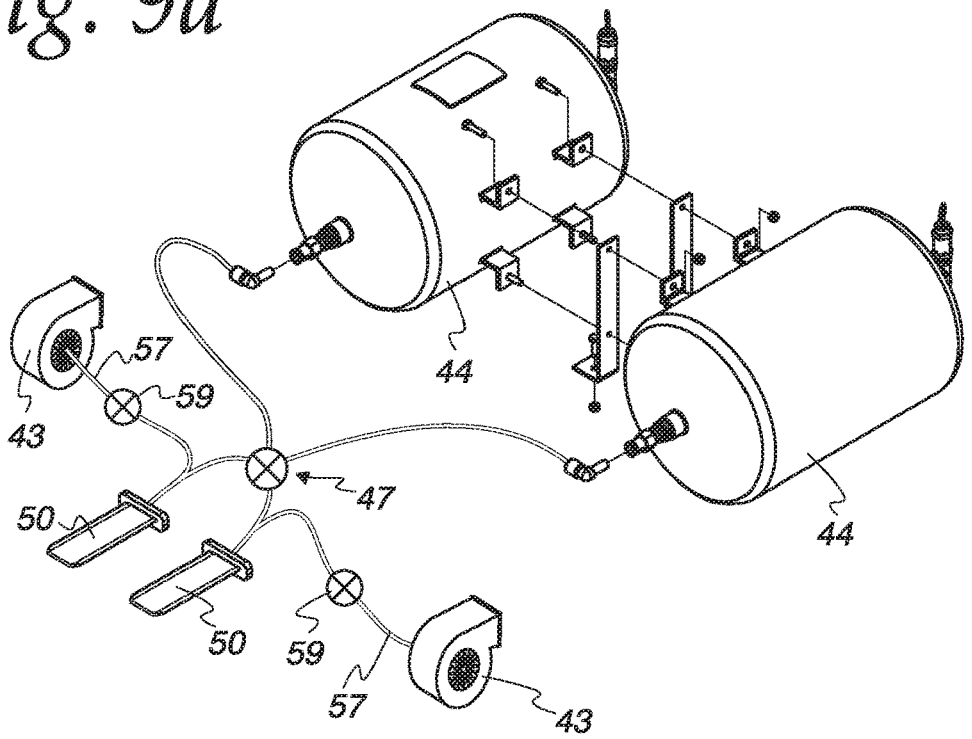
FIG. 9*a* is a detailed drawing of dual gas accumulation tanks according to the present invention, with a schematic illustration of a conduit-valve assembly connecting the accumulation tanks and vacuum pumps to dual snorkels.
Figure 9B:
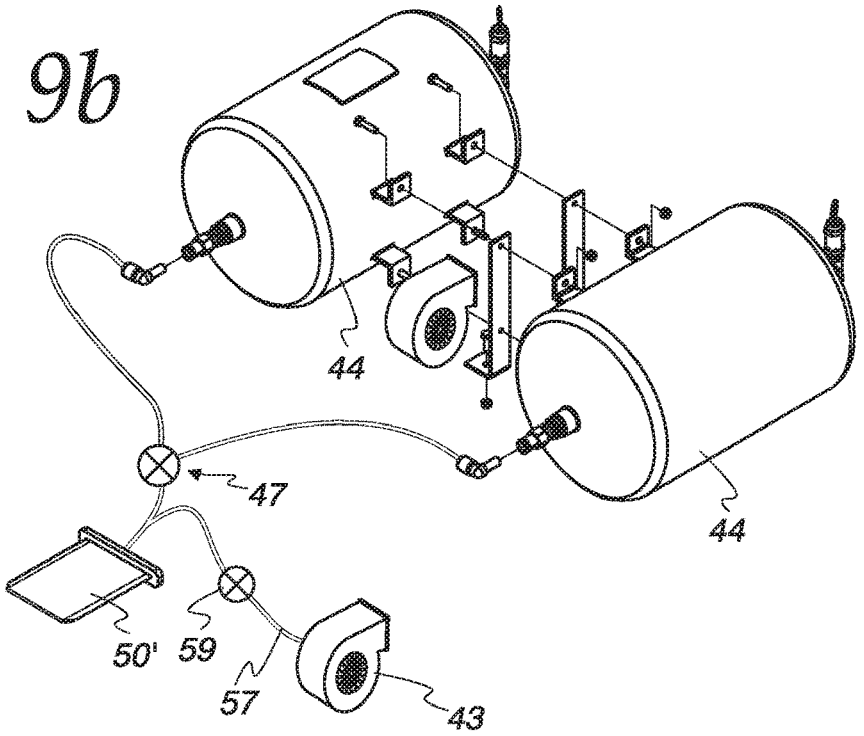
FIG. 9*b* is a detailed drawing of dual gas accumulation tanks according to the present invention, with a schematic illustration of a conduit-valve assembly connecting the accumulation tanks and a vacuum pump to the preferred single, wider snorkel.
Figure 9C:
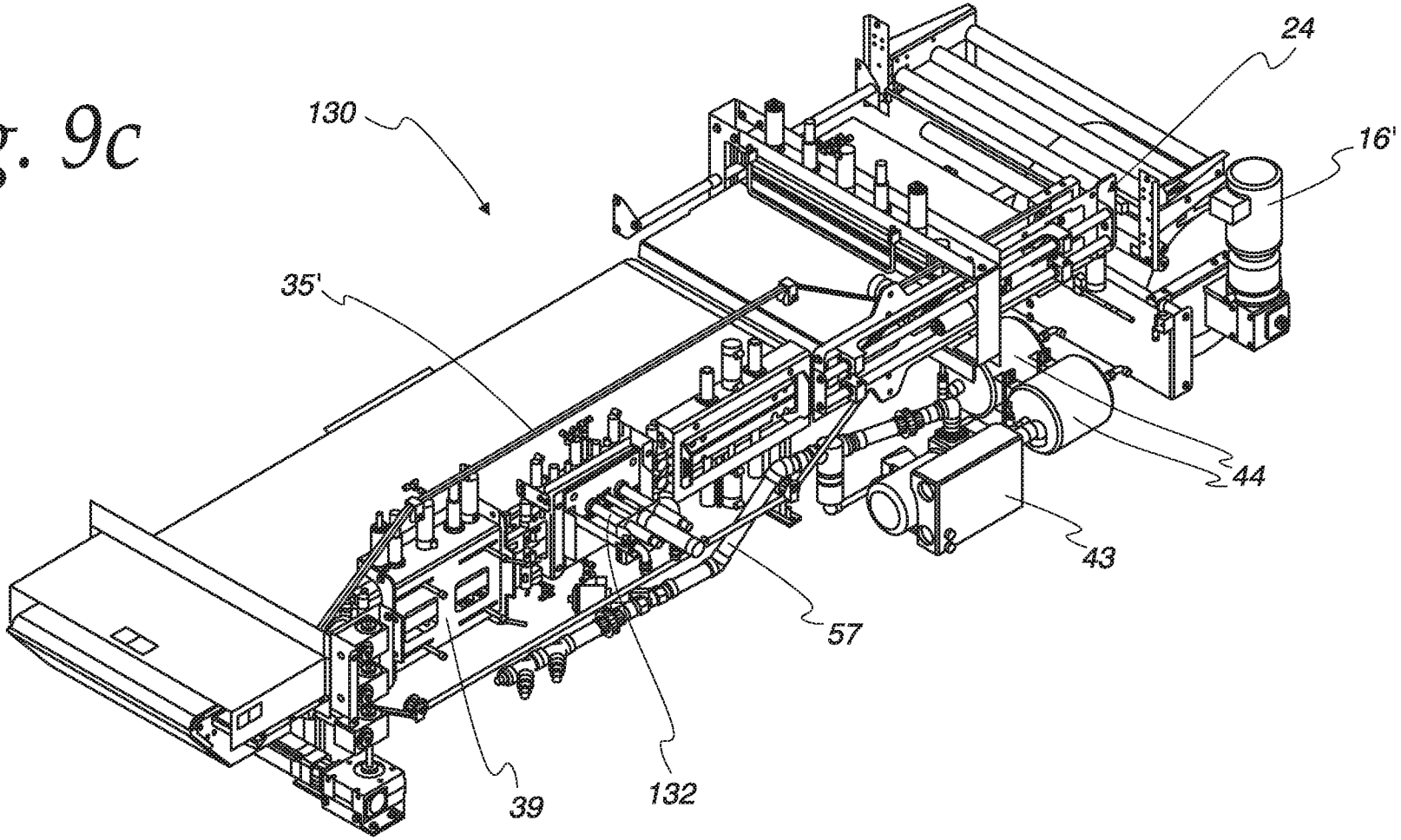
FIG. 9*c* is a perspective view of a preferred embodiment of an apparatus according to the invention, identifying the locations of gas accumulator tanks, a vacuum pump, a vacuum reservoir, and a fluid transfer station.

Turning to FIGS. 9*a* and 9*b*, a positive gas flow and vacuum pressure supply assembly is illustrated for dual snorkel and single snorkel embodiments, respectively. In FIG. 9*a*, dual gas accumulation tanks 44 are depicted in detail, and their connection to snorkels 50 via plumbing assembly 47 is illustrated schematically. Vacuum pumps 43 and their connections to each snorkel 50 are also illustrated schematically. Preferably, a vacuum reservoir 57 and a shut-off valve 59 are disposed between each pump 43 and each snorkel 50, the shut-off valve 59 controlling the flow path between snorkels 50 and vacuum reservoirs 57. This permits pumps 43 to create a vacuum in each vacuum reservoir 57 when shut-off valves 59 are closed, so that practically instantaneous vacuum pressure is provided to snorkels 50 when shut-off valves 59 are opened. This arrangement advantageously speeds up the cycle time associated with purging each pouch 22. A similar, preferred arrangement is illustrated for a single pump 43 and single vacuum reservoir 57 associated with a single wider snorkel 50' in FIG. 9*b*. With reference to FIG. 9*c*, gas accumulator tanks 44, vacuum pump 43, vacuum reservoir 57, and a fluid transfer station 132, where snorkels 50, 50' (hidden) may be located, are depicted in greater detail to show how they may be configured into a packaging apparatus 130. It should be noted that packaging apparatus 130 is shown to include what the present inventors believe to be generally the most preferred features of an apparatus according to the invention, including unwind motor 16' that directly powers web spool 14, a single pair of timing belts 35' that serve the functions of both film take-up timing belts and seal timing belts, pre-perforation knife assembly 24 (generally preferable to post-cut assembly 64 described below), and vacuum reservoir 57. However, packaging apparatus including some other selected combination of the components and features described herein may be preferable under particular circumstances.

Figure 14A:
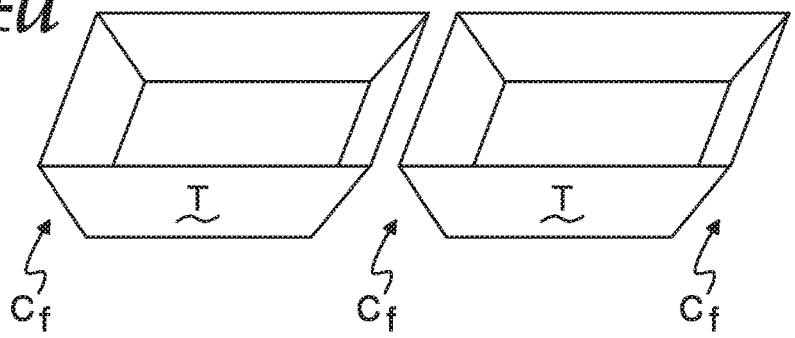
FIG. 14*a* is a perspective view of typical trays that may contain products to be packaged by an apparatus according to the invention.
Figure 14B:
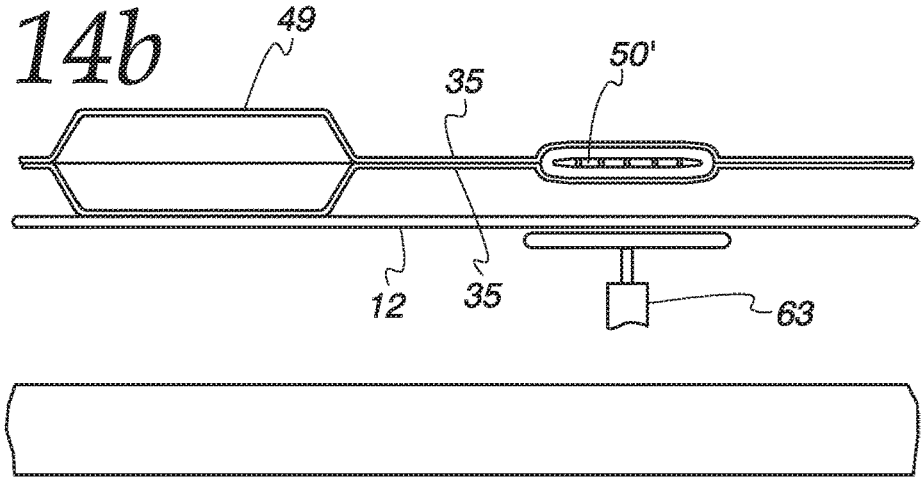
FIG. 14*b* is a schematic side illustration of the vertical offset of a snorkel from a web conveyor belt and of a conveyor belt lifting mechanism according to another aspect of the invention.
Figure 14C:
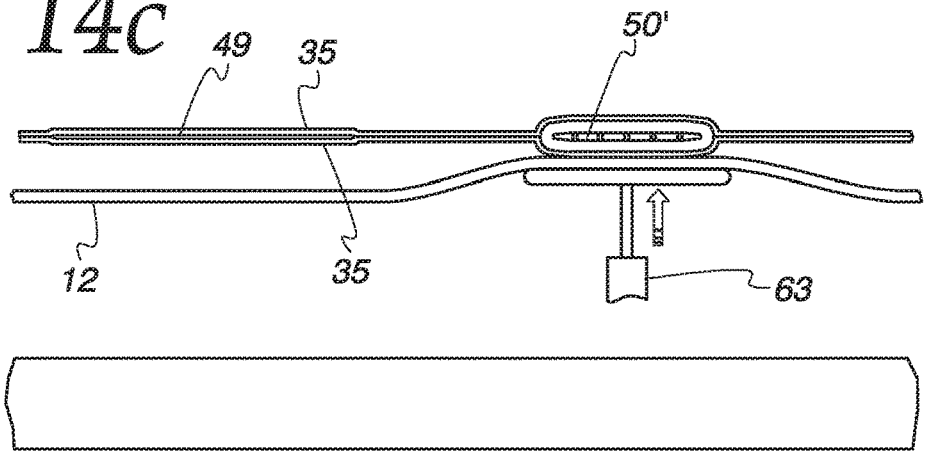
FIG. 14*c* is a schematic side illustration of the conveyor belt lifting mechanism lifting the web conveyor belt to the vertical level of the snorkel.

Noting that perishable products are commonly stored on trays similar to trays T shown in FIG. 14*a*, with a tapered profile that is narrower at the bottom, the present inventors have discovered that it is advantageous to be able to insert snorkels 50, 50' near the bottom of such trays to take advantage of fluid channels $C_f$ that are inherently formed around the lower periphery of such trays for more efficient fluid purging and refilling. However, because a spreader bracket in its expanded configuration is typically much taller than a suitable snorkel, referring to FIGS. 14*b* and 14*c* for the case of spreader bracket 49 and single snorkel 50', and because snorkel 50' should be aligned longitudinally with the spreader bracket 49 to avoid slipping of timing belts 35 relative to each other, the result is that snorkel 50' is elevated above the general path of the upper surface of conveyor belt 12 on which trays T rest. (Pouches 22 and trays T are omitted from FIGS. 14*b* and 14*c* to clearly show the relationships between spreader bracket 49, snorkel 50', timing belts 35, and conveyor belt 12.) Therefore, it is advantageous to provide a lifting mechanism 63 configured to raise conveyor belt 12 to the level of snorkel 50' when a pouch 22 containing trays T is located at fluid transfer station 38, so that snorkel 50' may be inserted near the bottom of trays T, substantially at the vertical level of fluid channels $C_f$.

Figure 15:
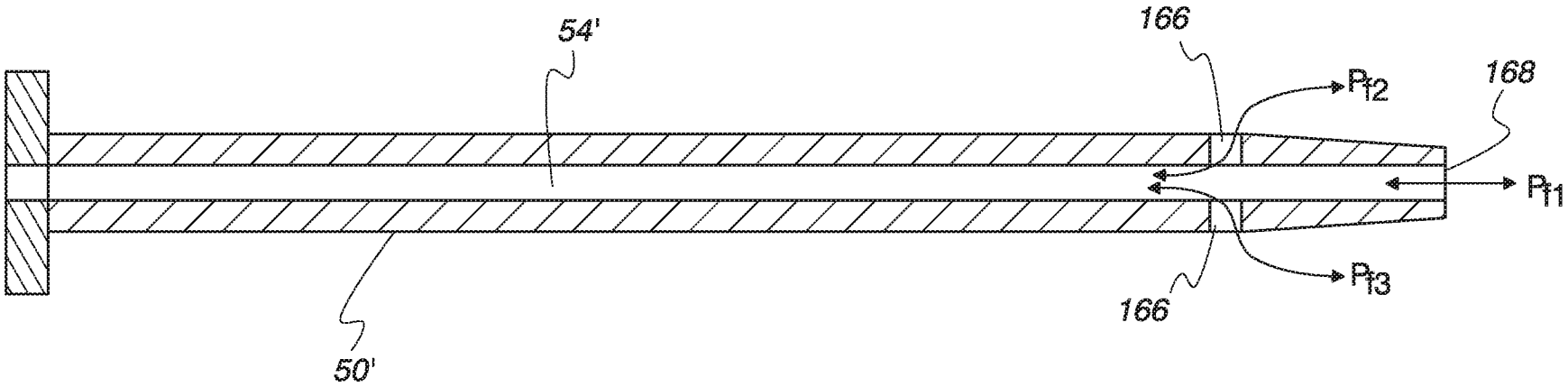
FIG. 15 is a cross-sectional side view of a preferred snorkel according to the invention, illustrating alternate flow pathways into and out of the snorkel.

With reference to FIGS. 8*c* and 15, efficient purging and refilling of pouches 22 may also be facilitated by one or more apertures 166 in snorkels 50' located above and/or below passage 54' so that gases may flow into and out of pouches 22 in more than one direction, shown in FIG. 15 as bi-directional flow pathways $P_{f1}$, $P_{f2}$, $P_{f3}$. Apertures 166 not only increase the likelihood that one or more of the flow pathways $P_{f1}$, $P_{f2}$, $P_{f3}$ into and out of snorkels 50' is advantageously aligned with one more flow channels inherently formed by one or more product trays in a pouch 22, thus for example providing adaptability to different sizes and shapes of products and product trays to be packaged in pouches 22, but they also provide alternate flow pathways so that gas flow is not entirely occluded should pouch 22 collapse over some but not all of the flow openings provided by apertures 166 and a mouth 168 of snorkels 50'.

In one embodiment, a control system (not shown) is operatively connected to infeed motor 16, conveyor belt 12, timing belt pulleys 36, 46, pre-perforation knife assembly 24, side perforator-sealer 28, product infeed station 34, fluid transfer station 38, and proximal sealing station 39. The control system causes infeed motor 16, conveyor belt 12, and timing belt pulleys 36, 46 to intermittently advance web 20 by an incremental distance approximately equal to the width w of pouch 22, as depicted in FIG. 1, and while web 20 is stationary, causes the foregoing components to operate simultaneously on the corresponding portions of web 20 and the corresponding pouches 22 that are positioned at their respective stations. Preferably, the control system includes a servo mechanism (not shown) by which conveyor belt 12 and timing belt pulleys 36, 46 are mechanically powered by and thus inherently synchronized with a single motor.

To prevent fluid contamination of the modified atmosphere for product P, it is beneficial that the web transfer means maintain a gas-tight seal as flexible pouch 22 is moved from fluid transfer station 38 to proximal sealing station 39. According to the embodiment shown in FIG. 1, such aspect of this invention is accomplished with the aid of seal timing belts 45, which are driven by timing belt pulley 46. Seal timing belts 45 are positioned transversely inward of transfer timing belts 35, to better overlap side edge seals 25, and above and below each flexible pouch 22 so that the timing belts compress both layers of web 20 together to prevent any leakage. Alternatively, seal timing belt 45 may be replaced with any other suitable belt or other device adapted to compress the layers of web 20 as they are moved. However, it should be noted that, depending on the working environment within flexible pouches 22 and other design parameters, seal timing belts 45 are not necessary if film take-up timing belts can be configured to accomplish adequate results. As noted above, the present inventors have in fact found that a single pair of opposed timing belts 35', functioning both as film take-up and seal timing belts, is adequate for maintaining a gas-tight seal in typical food packaging applications, as shown in FIG. 9*c*.

Figure 10:
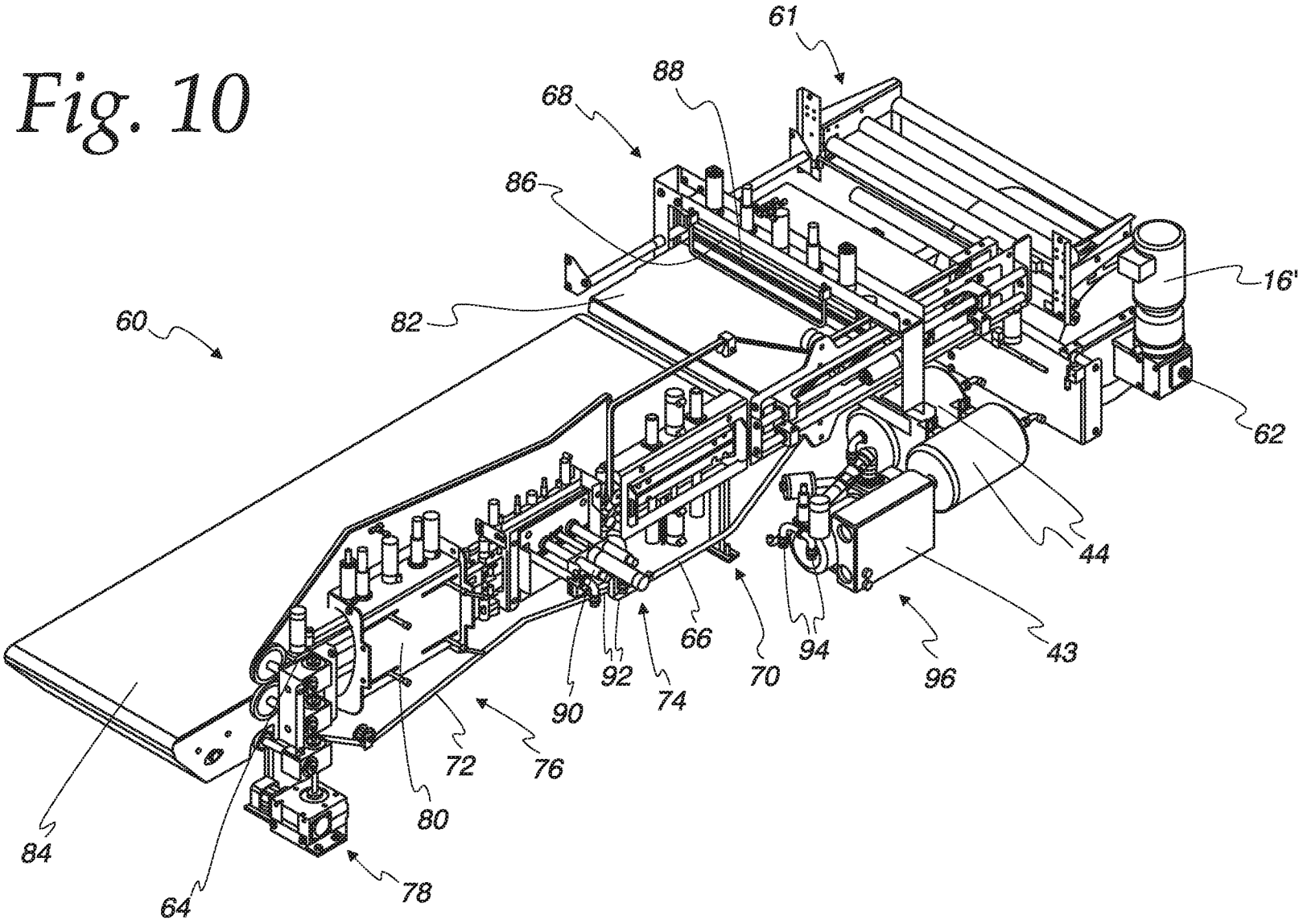
FIG. 10 is a detailed drawing of another embodiment of an apparatus according to the invention.

Turning to FIG. 10, an alternative embodiment of the apparatus of the present invention is illustrated in detail, where web 20 has been omitted for simplicity of illustration. Apparatus 60 differs from apparatus 10 in three significant respects. First, apparatus 60 includes a motor 16' associated with a web unwind assembly 61 configured to power a web spool 62 directly, with the benefits discussed above. Second, apparatus 60 is not configured to provide a pre-perforation across proximal web portion 31, but rather includes a post-cut assembly 64 for cutting across proximal web portion 31 to completely sever adjacent pouches only after they have been proximally sealed. As will be explained, a post-cut system has some advantages and some disadvantages compared to a pre-perforation system.

The components of post-cut assembly 64 may substantially resemble pre-perforation assembly 24 as shown in FIG. 3*a*, but with a post-cut knife adapted to form a continuous cut in film 20. In one embodiment, post-cut assembly 64 comprises an L-shaped knife (not shown) to make an L-shaped post-cut 98, as described in more detail below with reference to FIG. 11. Third, rather than including only a single pair of transfer timing belts, apparatus 60 includes first timing belts 66 to guide proximal web portion 31 past an edge cutting and sealing station 68 and through a product infeed station 70, where second timing belts 72 take hold of proximal web portion 31 to guide it from product infeed station 70 through a fluid transfer station 74 and a proximal sealing station 76, and finally to a post-cut station 78 where post-cut assembly 64 makes a post-cut across proximal web portion 31 that meets with side-edge cut 30 to separate each pair of sealed adjacent pouches 22. In this embodiment, timing belts 72 are configured to at least substantially maintain a gas-tight seal in pouches that are transferred from fluid transfer station 74 to proximal sealing station 76.

As shown in FIG. 10, second timing belts 72 are located slightly to the distal side of first timing belts 66. This permits the proximal ends of side edge seals 25 to be exposed on the proximal side of second timing belts 72, so that a proximal sealing assembly 80 can be configured to apply a proximal seal on the proximal side of second timing belts 72. The present inventors have found that this configuration avoids the problem of wrinkles in the proximal seal which are frequently formed when the proximal seal is applied inboard of a transfer timing belt, due to rippling of the film layers close to the product in the pouch. More importantly, for apparatus 60 to be adapted for post-cuts instead of pre-perforations, second timing belts 72 must be at a more distal location than first timing belts 66 to expose the proximal ends of side edge cuts 30, so that post-cut assembly 64 located to the proximal side of second timing belts 72 may form post-cuts that intersect side edge cuts 30. Thus, one advantage of a pre-perforation system over a post-cut system is that this need for a second pair of timing belts distally offset from a first pair of timing belts is avoided in a pre-perforation system. Pre-perforation can be conveniently performed before the take-up timing belts initially take up the film, so that the belts do not interfere, unlike post-cutting which must be performed after the pouches are sealed.

Also illustrated in FIG. 10 are some more specific details that may be included among the general components of an apparatus according to the invention. For instance, apparatus 60 is shown to include a stationary shelf 82 upline of a conveyor belt 84. Shelf 82 provides a stationary mounting surface for a resilient foot pad 86 against which a side edge sealing and cutting head 88 is pressed to form side edge cuts and seals in the web. A sliding snorkel assembly 90 having dual snorkel inlets 92 is also shown in more detail. Flexible hoses connecting dual outlets 94 of a vacuum/positive pressure supply system 96 have been omitted for simplicity of illustration. By way of example and not limitation, the specific details of other components also shown in FIG. 10 will be apparent to those skilled in the art.

Figure 11:
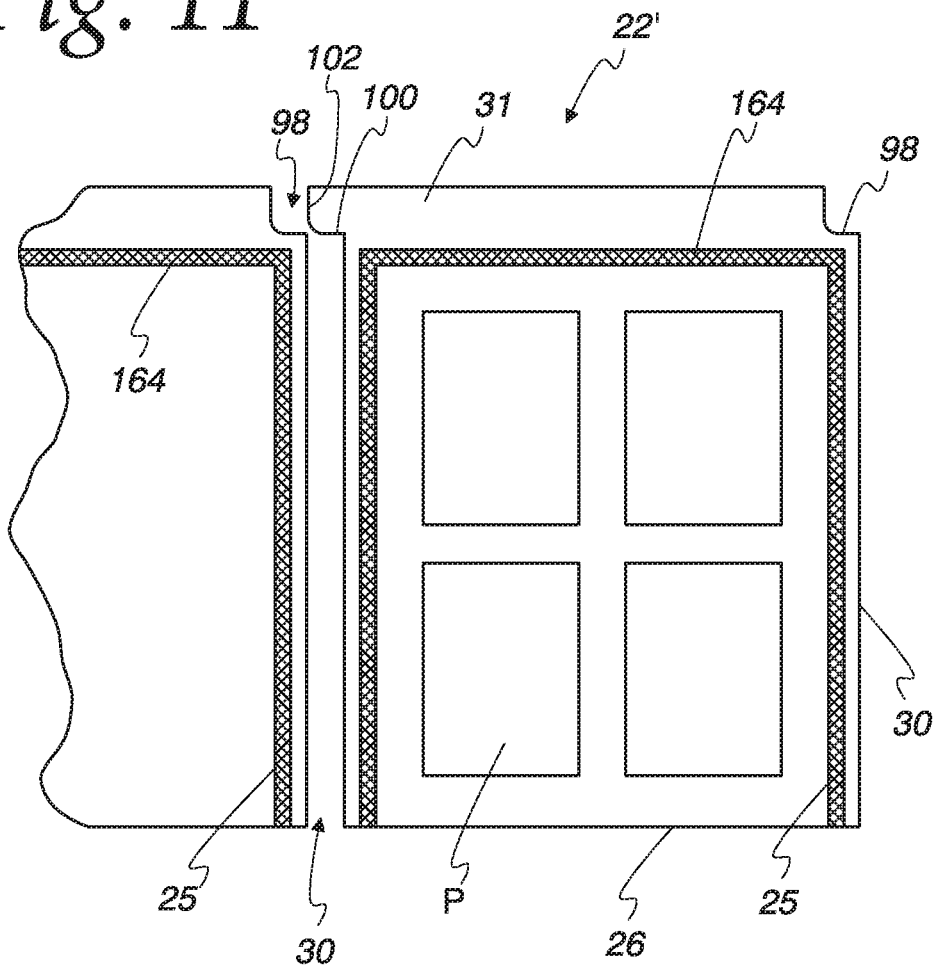
FIG. 11 is an illustration of a sealed pouch formed by the apparatus shown in FIG. 10.

Turning now to FIG. 11, a sealed pouch 22' that may be formed by apparatus 60 is illustrated, including L-shaped postcuts 98 at its proximal corners, as well as other features previously shown and described with reference to FIGS. 1 and 4. The L shape of postcuts 98 is advantageous in that a base leg 100 provides even more leeway for slight misalignment than the diagonal pre-perforations 27 made by apparatus 10, while a vertical leg 102 connects to the base leg and completes a transverse cut across proximal web portion 31 to permit separation of adjacent pouches 22'. In contrast to pre-perforation assembly 24 of apparatus 10, the location of post-cut assembly 64 downline of the other stations, where there is no longer a need for proximal portion 31 to remain intact, permits post-cut 98 to be an L-shaped cut as opposed to a diagonal cut, with the attendant advantages, as well as a complete cut, with the advantage of eliminating the need for an additional tearing step.

Figure 12:
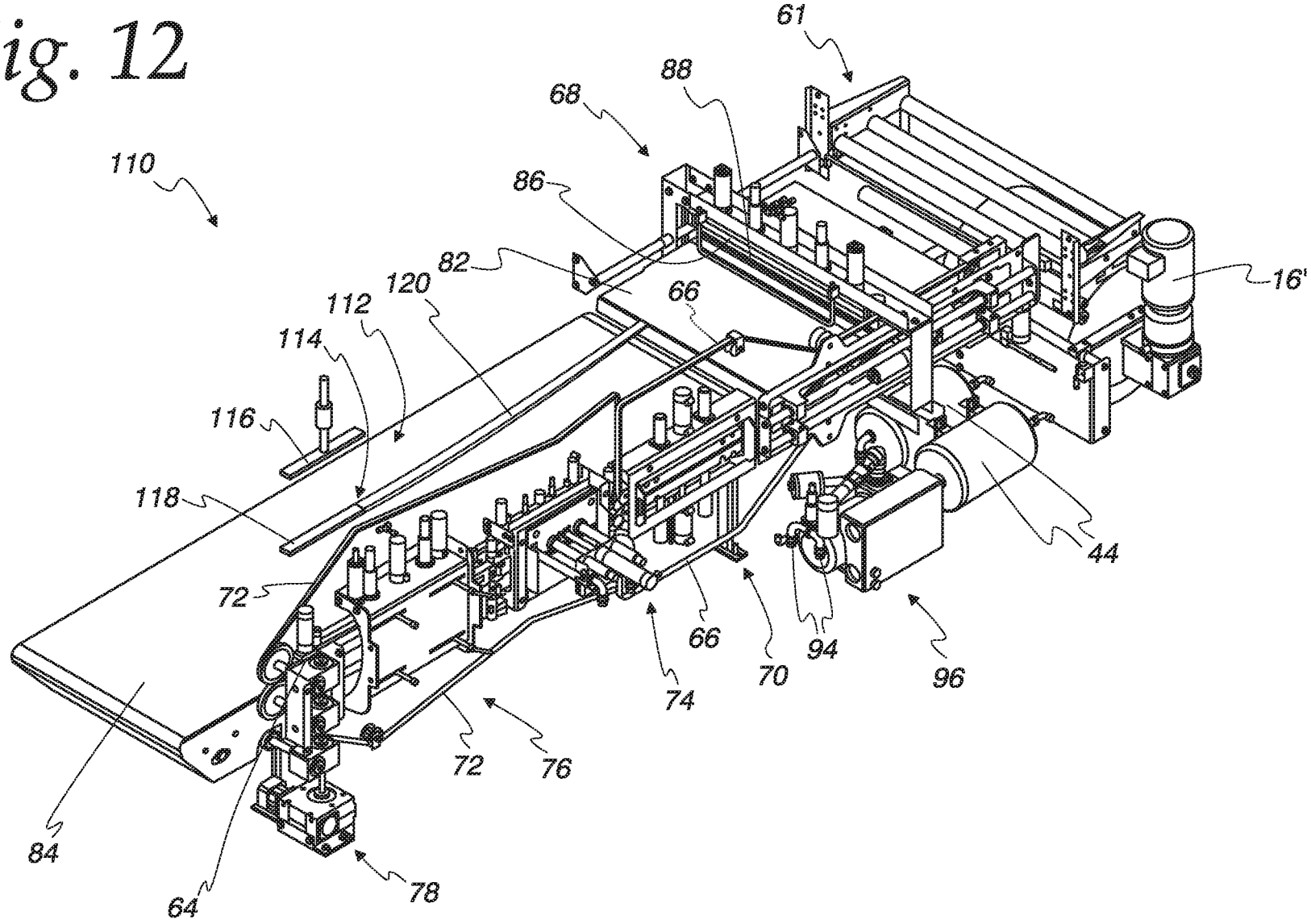
FIG. 12 is a detailed drawing of another embodiment of an apparatus according to the invention.

Another alternative embodiment of an apparatus 110 according to the present invention is illustrated in FIG. 12. This embodiment is substantially similar to apparatus 60 as illustrated in FIG. 10, while apparatus 110 further includes a center sealing assembly 112 comprising a base 114 and a center sealing head 116. Base 114 includes a resilient sealing foot pad 118 mounted to an elongate guide member 120, which is in turn attached to shelf 82. In this manner, foot pad 118 is restrained from being carried downline by conveyor belt 84, and rather simply "floats" over conveyor belt 84. Besides thus holding foot pad 118 in position, guide member 120 is configured to perform the additional functions of guiding a web onto foot pad 118 as the web is advanced by transfer timing belts 66 and 72 and conveyor belt 84, and separating products into proximal and distal regions of the conveyed pouches when they are inserted at product infeed station 70. In this manner, the products may be sealed into separate proximal and distal compartments of the pouches separated by a center seal formed by center sealing assembly 112. Although center sealing assembly 112 is depicted in FIG. 12 as slightly closer to folded edge 26, so as not to be obscured behind second transfer timing belt 72 in the drawing, center sealing assembly 112 may typically be approximately centered between folded edge 26 of web 20 and the outboard edge of second transfer timing belt 72, so as to form a center seal that divides a pouch roughly into two equal compartments. However, it is within the scope of the invention for one or more similar sealing assemblies to be disposed at any location between folded edge 26 and second timing belt 72 to provide a plurality of separate compartments of desired size and configuration in each pouch.

Figure 13:
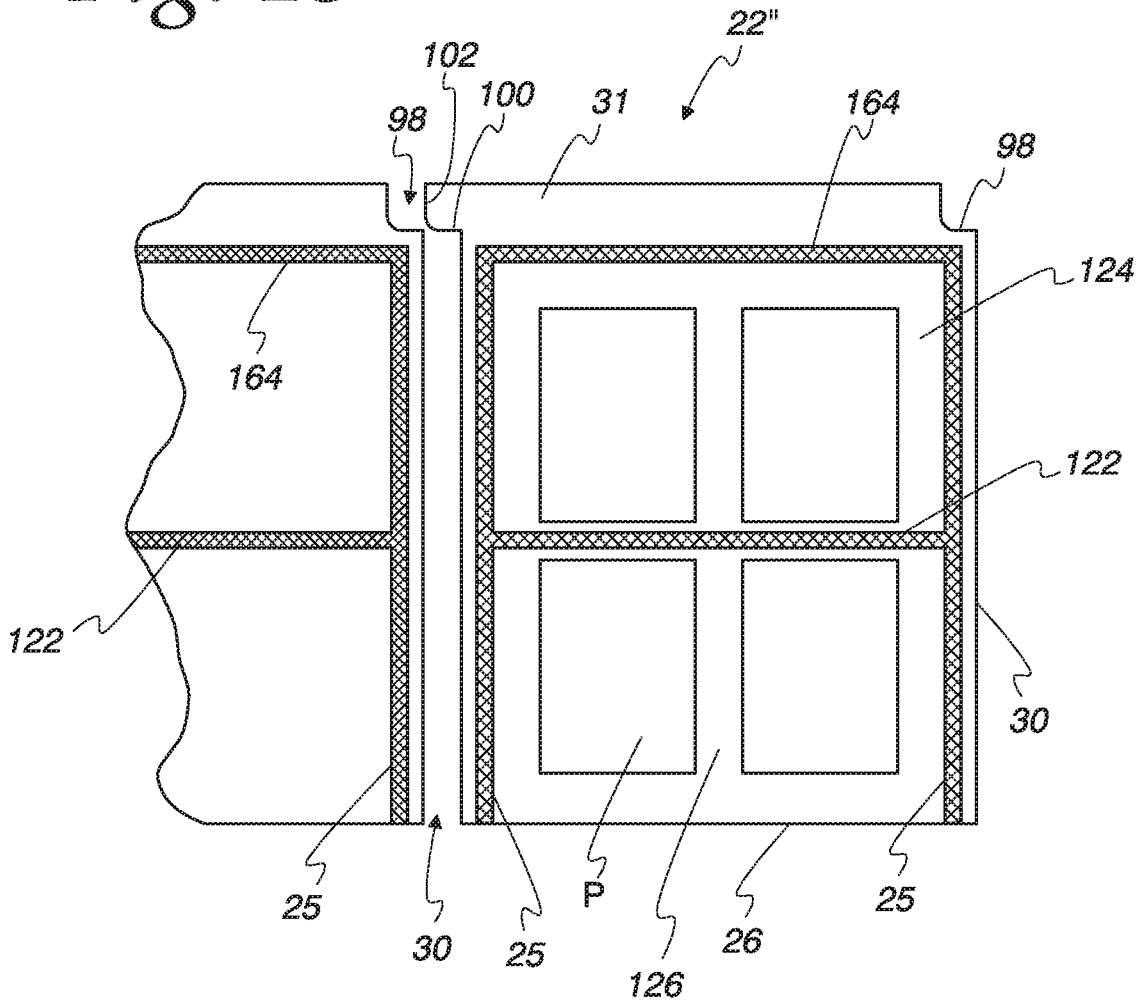
FIG. 13 is an illustration of a sealed pouch formed by the apparatus shown in FIG. 12.

Turning to FIG. 13, a sealed pouch 22" that may be formed by apparatus 110 is illustrated, sealed pouch 22" including a center seal 122 in addition to features previously shown and described with reference to FIGS. 1,4 and 11. Center seal 122 divides pouch 22" into proximal and distal compartments 124 and 126, each containing products P. Advantageously, this enables a consumer or retail seller to open only one compartment at a time until the product therein is used, consumed or sold, thus keeping the product in the unopened compartment in its modified atmosphere for a longer time. If the product comprises perishable items, the perishable items in the unopened compartment are thus kept fresher for a longer time.

With reference to FIGS. 16-20, mechanisms for separating a sealed pouch from the web are described and illustrated which may be preferred for certain implementations of the apparatus and methods of the invention having a pre-perforated proximal web portion. In particular, when the product sealed in sealed pouch 22 or 22" is relatively lightweight, static friction between sealed pouch 22 or 22" and takeaway conveyor 134 may be insufficient to generate enough pulling force to tear sealed pouch 22 or 22" off of web 20 as in the embodiment of the invention illustrated in FIG. 4*b*. In such cases, it is desirable to provide a mechanism that grips proximal portion 31 of sealed pouch 22 or 22" from above and below and pulls proximal portion 31 in a downline direction to separate pouch 22 or 22" from web 20. Such a tear-off mechanism could be advantageously incorporated in a packaging apparatus of a general type that loads products into a web of interconnected bags to form product pouches, regardless of whether the packaging apparatus produces sealed pouches with a modified atmosphere or whether bag-making is performed in-line with filling and sealing.

Figure 16:
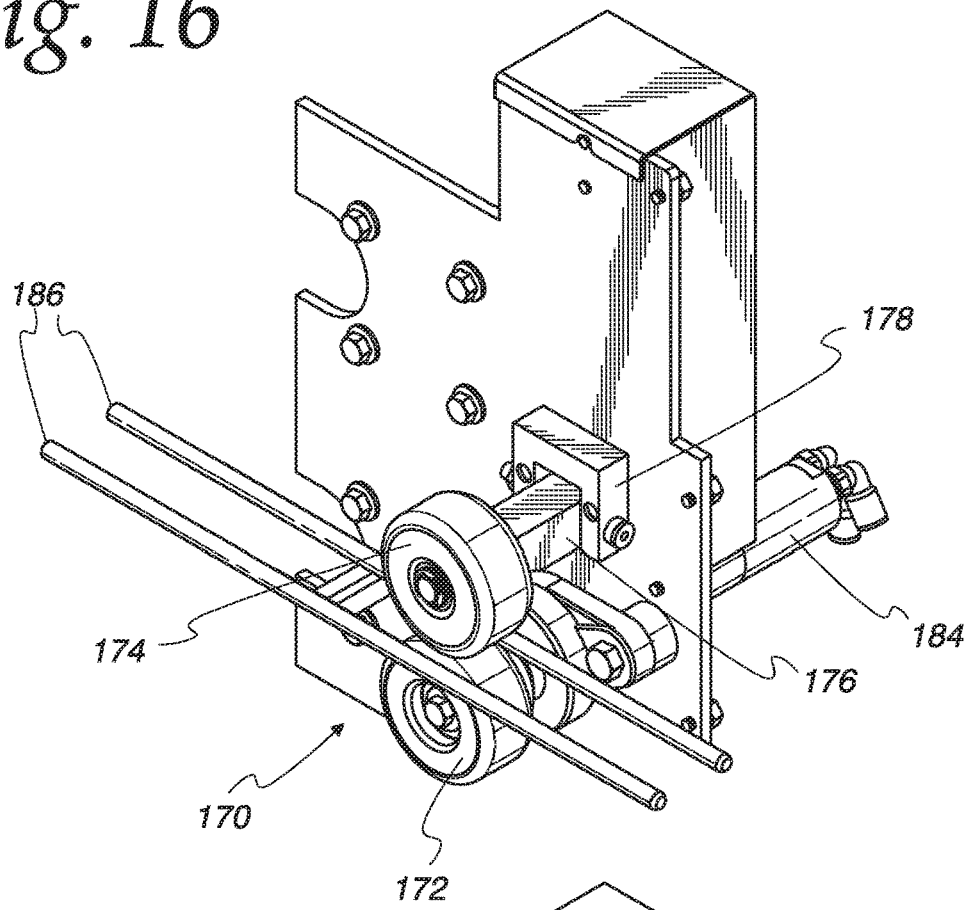
FIG. 16 is a perspective view of a tear-off mechanism according to the invention, shown in a gripping position.
Figure 17:
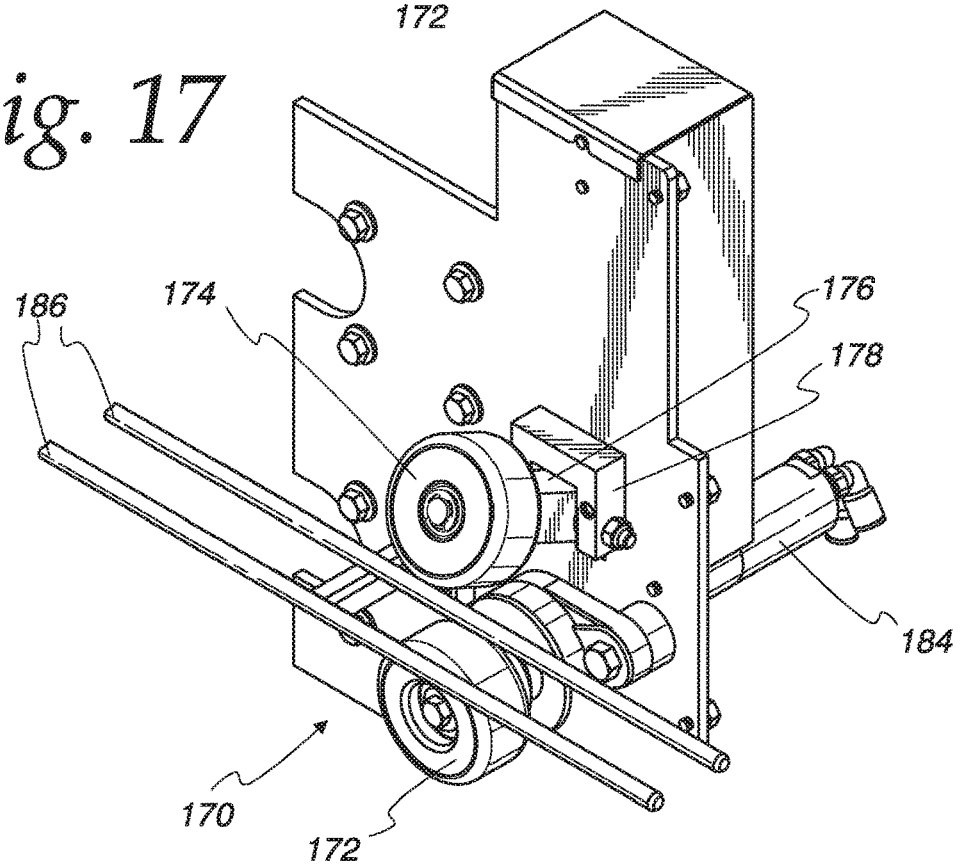
FIG. 17 is a perspective view of a tear-off mechanism according to the invention, shown in an open position.
Figure 18:
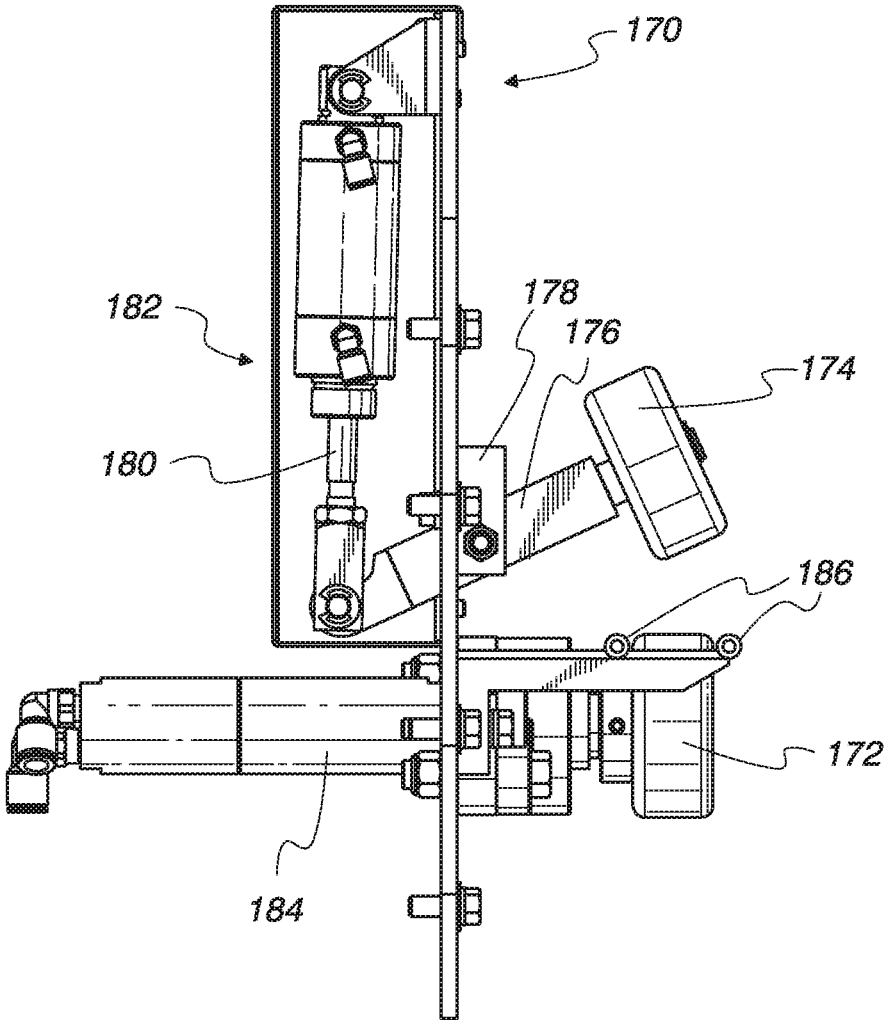
FIG. 18 is a rear elevation view of a tear-off mechanism according to the invention, shown in an open position.

One such tear-off mechanism is a double-roller tear-off mechanism 170 as illustrated in FIGS. 16-18. Tear-off mechanism 170 includes a fixed-axis roller 172 and a pivoting roller 174, which happen to be a lower roller and an upper roller respectively, though the lower roller or both rollers could instead be pivoting. Pivoting roller 174 is rotatably connected to a pivoting arm 176. Pivoting arm 176 is in turn pivotally mounted to a fixed base 178 and to a piston member 180 of a piston-cylinder assembly 182, shown in FIG. 18. Thus, pivoting arm 176 is pivoted upward to a disengaged position shown in FIGS. 17 and 18 when piston member 180 is extended, and downward to an engaged position shown in FIG. 16 when piston member 180 is retracted. In the engaged position, rollers 172 and 174 engage each other so as to grip proximal portion 31 of web 20 between them. Automated pivoting of roller 174 may optionally be performed by extension and retraction of a compressed gas cylinder assembly, as best illustrated in FIG. 18, or by any other suitable means.

Roller 172 is driven by a motor 184. Optionally, roller 174 may also be driven, although providing roller 174 as a freewheel has the advantage of simplifying and reducing the cost of mechanism 170 by avoiding the need to provide either a motor (not shown) that pivots together with arm 176 or a transmission system (not shown) linking a fixed drive shaft to a pivoting axle of roller 174.

Figure 19:
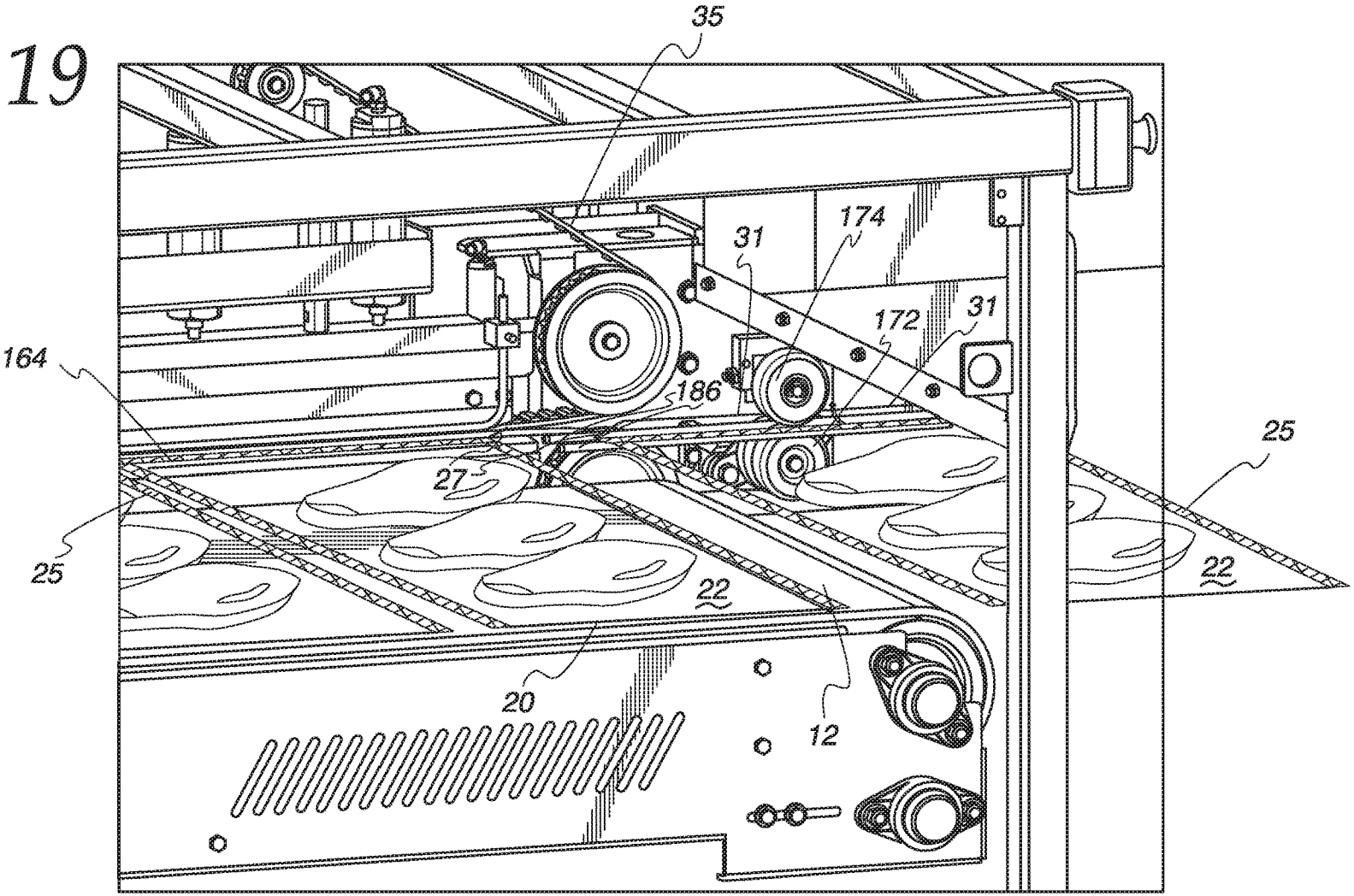
FIG. 19 is a partial perspective view of a packaging apparatus of the invention, illustrating the position of a sealed pouch ready to be separated from the web by a tear-off mechanism.
Figure 20:
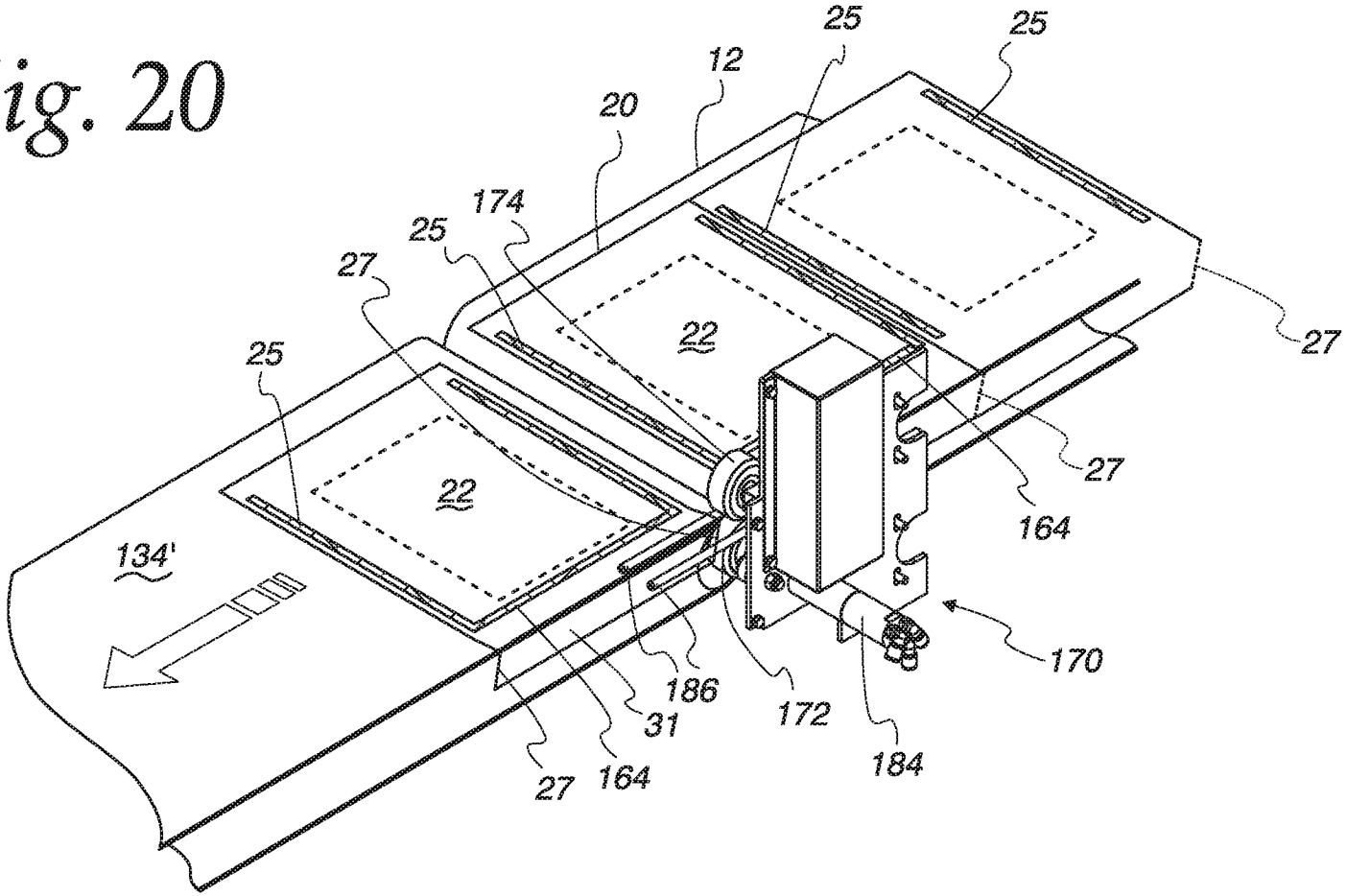
FIG. 20 is a fragmentary perspective view of a main conveyor, takeaway conveyor, web, and tear-off mechanism of the invention, illustrating the position of a sealed pouch just after separation from the web by a tear-off mechanism.

Tear-off mechanism 170 is located downline of transfer timing belts 35 to allow rollers 172, 174 to grip a sealed pouch 22 that is clear of the downline ends of the opposed portions of transfer timing belts 35 as illustrated in FIG. 19. Runners 186 are provided to help guide proximal portion 31 of web 20 between rollers 172 after it is fed out of timing belts 35. Thus, when web 20 reaches the orientation depicted in FIG. 19, web conveyor belt 12 and transfer timing belts 35 stop advancing, and pivoting arm 176 pivots downward to the engaged position as shown, gripping proximal portion 31 of sealed pouch 22 between rollers 172 and 174. Motor 184 then transmits a pulse of clockwise rotation to roller 172 to advance pouch 22 while web 20 remains stationary, tearing pre-perforation 27 to separate pouch 22 from web 20. As desired, the newly separated pouch 22 may be supported by web conveyor belt 12 (optionally to be conveyed onto a takeaway conveyor 134' by web conveyor belt 12 only after being separated from web 20, as depicted in FIG. 20), by a stationary table surface (not shown) adjacent the end of web conveyor belt 12 as depicted in FIG. 19, by a takeaway conveyor 134' adjacent the end of web conveyor belt 12, or not at all, and simply permitted to drop into a bin or chute (not shown), for example.

In addition to the double-roller type of tear-off mechanism as exemplified by tear-off mechanism 170, many other variations of a gripping tear-off mechanism are also possible within the scope of the present invention. For example, in one embodiment, roller 174 may be replaced by a smooth, gripping member made of a low-friction material such as PTFE or silicone (not shown), so that when the gripping member presses proximal portion 31 against roller 172, the bottom side of proximal portion 31 frictionally engages roller 172, while the top side of proximal portion 31 is able to slide along the gripping member as roller 172 advances. In still another embodiment, instead of dual rollers, a mechanism may comprise a pair of gripping pads (not shown), one or each of which pivots or translates into gripping engagement with the other, followed by both pads pivoting or translating generally in the downline direction, while still gripping a portion of a sealed pouch, to tear the sealed pouch from a web.

While the invention has been described with respect to certain embodiments, as will be appreciated by those skilled in the art, it is to be understood that the invention is capable of numerous changes, modifications and rearrangements, and such changes, modifications and rearrangements are intended to be covered by the following claims.

What is claimed is:

1. A packaging method comprising providing a two-ply web of interconnected bags having a closed distal longitudinal edge and an open proximal longitudinal edge, each bag in the web being joined to its neighboring bags only by a proximal longitudinal strip of the web, and each bag including a closed distal end comprising part of the closed distal longitudinal edge, closed side edges extending from the closed longitudinal edge of the web approximately to the proximal longitudinal strip, and an opening comprising a portion of the proximal longitudinal strip;

gripping a portion of the proximal longitudinal strip between a pair of longitudinally oriented, endless, opposed belts;

forming a perforation extending across the proximal longitudinal strip to a proximal end of each pair of adjacent free side edges of neighboring bags, before feeding the perforated portion of the proximal longitudinal strip between the opposed belts;

at least substantially supporting on a web conveyor a portion of the web extending from the opposed belts to the closed longitudinal edge in a generally horizontal orientation, the web conveyor configured to advance simultaneously with said opposed belts to advance the web longitudinally to advance each bag successively to each of a plurality of stations;

advancing one of the bags to a product infeed station, separating the plies of the opening of said one of the bags at the product infeed station, and inserting a product into said opening;

advancing said one of the bags containing the inserted product to a sealing station, and forming a seal on said one of the bags generally extending from one side of the bag to the other, to form a sealed pouch containing the inserted product;

advancing said sealed pouch to a tear-off station where at least a portion of said sealed pouch is an exposed portion located downline of the opposed belts;

gripping said exposed portion between opposed gripping members; and moving at least one of said opposed gripping members to pull said exposed portion in a generally downline direction, to tear said perforation, to separate said sealed pouch from the web, wherein at least one of the opposed gripping members of the tear-off assembly being a roller driven by a motor, said moving at least one of said opposed gripping members to pull said exposed portion in a generally downline direction comprising the motor driving the roller when the opposed belts are stationary and the other of the opposed gripping members being a freely rotating roller.

2. The method of claim 1, wherein said gripping said exposed portion and said moving at least one of said opposed gripping members to pull said exposed portion are performed while the opposed belts are stationary.

3. The method of claim 1, wherein said providing a two-ply web of interconnected bags comprises providing a c-folded two-ply web of film, periodically forming transverse side seals across said two-ply web of film, the side seals extending from the distal longitudinal edge approximately to the proximal longitudinal strip, and each side edge of each bag being defined by one of the side seals, and periodically forming transverse cuts between the side seals defining the adjacent edges of each adjacent pair of bags, each transverse cut extending from the closed longitudinal edge to a proximal end of the transverse cut located approximately between the proximal ends of the corresponding side seals.

4. The method of claim 1, wherein the freely rotating roller is movably mounted to the apparatus, further comprising moving the position of the axis of the freely rotating roller to an open position when the opposed belts are advancing, to facilitate feeding the web between the opposed gripping members, and to a gripping position when the opposed belts are stationary, to grip and pull the exposed portion in the generally downline direction.

5. The method of claim 4, further comprising, when the opposed belts are advancing, guiding the proximal longitudinal portion of the web fed out of the opposed belts over a longitudinal guide member to the approximate longitudinal location of the gripping members.

6. The method of claim 1, wherein at least one of the opposed gripping members is movably mounted to the apparatus, further comprising relatively moving the opposed gripping members to an open position when the opposed belts are advancing, to facilitate feeding of the web between the opposed gripping members, and to a gripping position when the opposed belts are stationary, to grip and pull the exposed portion in the generally downline direction.

7. The method of claim 6, further comprising, when the opposed belts are advancing, guiding the proximal longitudinal portion of the web fed out of the opposed belts over a longitudinal guide member to the approximate longitudinal location of the gripping members.

* * * * *